US008439731B2

(12) United States Patent
Umeda

(10) Patent No.: US 8,439,731 B2
(45) Date of Patent: May 14, 2013

(54) COIN SEPARATING AND TRANSFERRING APPARATUS FOR POSITIONING A SORTED COIN AT AN INTERIM STATIONARY POSITION

(75) Inventor: Masayoshi Umeda, Saitama (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/416,865

(22) Filed: Mar. 9, 2012

(65) Prior Publication Data

US 2012/0238196 A1 Sep. 20, 2012

(30) Foreign Application Priority Data

Mar. 17, 2011 (JP) ..... 2011-058901

(51) Int. Cl.
*G07D 3/00* (2006.01)

(52) U.S. Cl.
USPC ..... 453/12; 453/13; 453/33; 453/34; 453/35; 453/49; 453/57; 194/302

(58) Field of Classification Search ..... 453/57, 453/6, 10, 12, 13, 33–35, 49; 194/302
See application file for complete search history.

(56) References Cited

U.S. PATENT DOCUMENTS 4,752,274 A * 6/1988 Abe ..... 453/32
2009/0029638 A1* 1/2009 Enomoto ..... 453/57

* cited by examiner

*Primary Examiner* — Jeffrey Shapiro

(57) ABSTRACT

A compact inexpensive coin separating and transferring apparatus can separate coins and reliably delivering each one to a rotating transferring body. Coins or tokens are contacted by a holding surface on a pusher unit formed so as to project from an upper surface of a rotary disk to permit the coins to be sorted one by one and stored. The coins are each pushed by the pusher unit along a circumferential-direction of a fixed guiding ledge positioned above the rotary disk. The coin reaches a stationary state at a predetermined delivery position on a delivery support ledge. A holding ledge has a predetermined diameter formed at an outer perimeter edge of the pusher. The coin is removed by a rotary transferring body from the delivery position, and physical properties can be detected by a sensor while moved along a sensor-part guide.

20 Claims, 18 Drawing Sheets

(A)

(B)

(A)

(B)

COIN SEPARATING AND TRANSFERRING APPARATUS FOR POSITIONING A SORTED COIN AT AN INTERIM STATIONARY POSITION

BACKGROUND OF THE INVENTION

1. Field of the Invention

The present invention relates to a coin separating and transferring apparatus for sorting coins of a plurality of denominations having different diameters, one by one, and sending the sorted coins to a subsequent process procedure. Also, the present invention relates to a coin separating and transferring apparatus for sorting coins having different diameters, one by one, and then delivering them to a stationary position, on a rotary disk, adjacent a transferring apparatus which transfers the coins to a sensor part.

2. Description of Related Art

A first conventional technology, of an apparatus disclosed in Japanese Unexamined Patent Application Publication No. 2007-114978, filed by the applicant is directed to a coin sending apparatus for a coin separating and transferring apparatus in which coins are held in a sorting recessed part placed on an upper surface of a rotary disk and sorted one by one. The coins are delivered to a rotating coin transferring apparatus, wherein a movable body forming a recessed part and movable in a diameter direction of the rotary disk is provided. The movable body is moved across a diameter direction of the rotary disk with a timed delivery to the coin transferring apparatus.

In the first conventional technology, coins are received in a recessed part, sorted one by one, and held therein. When the recessed part moves to a delivery position for the coin transferring apparatus, the movably body forming the recessed part moves in a diameter direction of the rotary disk, and the coins held in the recessed part are actively moved in the diameter direction of the rotary disk. Therefore, the coins can be delivered to the coin transferring apparatus at the moved position and the coin dispensing position can be controlled based on the movement position of the movable body, and therefore the dispensing position is advantageously not restricted. However, in the first conventional apparatus, a moving mechanism to move the movable body is required, thereby increasing the number of components and restricting any cost reduction.

Japanese Patent No. 4,093,753 discloses a coin feeding apparatus including a tilted disk having an upper part in a tilted posture toward a back direction, a columnar boundary periphery part formed of a low part and a high part of the tilted disk, a reservoir hopper frame forming a reservoir hopper accumulating coins between the reservoir hopper and a front surface of the tilted disk. A plurality of scraping projections are provided with predetermined pitches on a circumference of the front surface of the tilted disk at a predetermined radius position and rotate in conjunction with the tilted disk to scrape coins on a lower area of the tilted disk, one by one, to an upper area. A driving unit is provided for rotating and driving the tilted disk and the plurality of scraping projections. The apparatus scrapes coins in the lower area of the tilted disk via the scraping projections one by one to the upper area of the tilted disk to send the coins from a coin sending area of the upper area of the tilted disk.

The coin feeding apparatus is provided with an outer perimeter projection provided correspondingly to at least one of the plurality of scraping projections in an outer perimeter area of the scraping projections on the front surface of the tilted disk and supports two points of each of the coins in the lower area of the tilted disk in cooperation with the corresponding scraping projection and scraping the coin toward the upper area of the tilted disk.

U.S. Pat. No. 6,350,193 discloses that a coin feeder mechanism has been known, in which a plurality of lock pins for coins are provided with predetermined spacing therebetween on a same virtual circle in a rotating pinwheel and, after a coin is placed in a state of being fixed on a rotary disk, it is moved along a shelfwheel fixedly placed at a center part of the rotary disk. The coin is moved by the locking pins along a fixed knife extending in a circumferential direction continuously from a fixed shelfwheel.

Japanese Patent No. 3,981,372 discloses a rotary-disk-type coin sending apparatus has been known, in which the apparatus includes one body with one outlet. The apparatus includes one rotary disk is provided on the body. A coin transfer surface has a plurality of pushing columns aligned in radial rows. The plurality of pushing columns are fixed to the rotary disk and project from the coin transfer surface. A space between adjacent rows of the pushing columns serves as a coin accommodation space.

A guide arm is provided on the body and near the outlet to partially cover a coin transfer surface of the rotary disk. A guide wall and at least one arc groove on a bottom surface is configured to enable the arc guide to communicate with the guide wall, thereby allowing the pushing columns to rotate the rotary disk and pass through the guide arm. The rotary disk has a plurality of coin sliding projections in a shape of being gently tilted from the pushing columns onto the coin transfer surface. A plurality of coin sliding projections are formed on the coin transfer surface and are in contact with one side of the pushing columns opposite to the guide wall, thereby preventing a coin from being pushed to one side of the pushing columns.

SUMMARY OF THE INVENTION

A first object of the present invention is to provide a coin separating and transferring apparatus capable of separating coins one by one and reliably delivering each one to a rotating transferring body for subsequent processing.

A second object of the present invention is to provide a small-sized coin separating and transferring apparatus capable of separating coins one by one and reliably delivering each one to a rotating transferring body.

A third object of the present invention is to provide a small-sized, inexpensive coin separating and transferring apparatus capable of separating coins one by one and reliably delivering each one to a rotating transferring body.

To achieve these objects, the present invention is configured as follows.

A first embodiment of the invention includes a coin separating and transferring apparatus including a rotary disk having at least a lower-side portion slantly placed on a bottom part of a storage container for storing coins in a bulk state. The apparatus having formed therein a pusher unit projecting from an upper surface of the rotary disk, and having a projection amount above the rotary disk, smaller than a thickness of a coin having a thinnest thickness. The coins are in surface contact with a holding surface formed on the pusher unit. The coins are individually pushed by the pusher unit to be moved along a circumferential-direction guiding part extending from a center part of the rotary disk to a circumferential direction and provided in a fixed state over the rotary disk.

Subsequently, the coins are guided by a rotary transferring body rotating about an axial center to the circumferential-direction guiding part to a stationary position and subsequently moved to a sensor part. A coin support ledge formed on an upper side with respect to a rotation axis line of the rotary disk on an upper side of the holding surface and continuous to the circumferential-direction guiding part is provided.

The pusher unit projects as an arc segment or a rib shape with respect to the holding surface of the rotary disk and has a length in a circumferential direction substantially longer than a diameter of a coin having a largest diameter and, a holding edge is further formed on a rear side of a rotating direction of the rotary disk. The holding edge has a predetermined radius from the rotation axis line of the rotary disk and a predetermined length, and the coins are supported in a stationary state at a delivery position between the circumferential-direction guiding part and the holding edge to be pushed by the rotary transferring body.

A modification of the first embodiment provides the pusher unit with a rotation rear side continuous to the holding edge formed on an inclined surface and sequentially extending away from the upper surface from an outer perimeter edge side toward the rotation axis side of the rotary disk.

A further modification of the first embodiment has the pusher unit include a first pusher, positioned a predetermined first distance away from the rotation axis of the rotary disk and a second pusher positioned a second distance larger than the first distance away therefrom. When a coin having a smallest diameter is supported on the coin support ledge, the first pusher pushes a perimeter surface of the coin closer to the rotation axis than a center of the smallest diameter.

Wherein the second pusher is placed so as to push at least the coins having the smallest diameter moved by the first pusher along the circumferential-direction guiding body in a circumferential direction of the rotary disk.

The second pusher can further have a rotation rear side continuous to the holding edge formed on an inclined surface sequentially away from the upper surface from an outer perimeter edge side toward the rotation axis side of the rotary disk. A portion of the pusher, in contact with the coins, can be made of metal.

A further modification of the pusher unit is a configuration of divided pushers obtained by providing plural divisions in a circumferential direction, the divided pushers can individually go upward and backward with respect to the holding surface of the rotary disk, and the divided pushers can each individually sink toward the upper surface of the rotary disk when facing the circumferential-direction guiding part and are elastically projected upward from the holding surface when otherwise positioned.

Accordingly, coins stored in a storing container in a bulk state will face a lower end of the upper surface of the rotary disk. Then, pushers projecting from the upper surface of the rotary disk can proceed through the coins in bulk, and therefore the coins in the bulk are mixed by the pushers and are variously changed in posture. Then, when one of the obverse head and the reverse tail of one coin among these plurality of bulk coins are brought into surface contact with a holding surface defined by the pusher of the rotary disk, the surface-contacted coin is then pushed by the pusher and moves together with the rotation of the rotary disk.

The coin is in surface contact with the upper surface in approximately a lower-side partial area of the rotary disk and the perimeter surface of the coin is pushed as being guided by an inner perimeter surface of the storing container.

The space between the pushers in a circumferential direction is set so that a space in which two coins having the smallest diameter cannot be in contact with each other with the coins in surface contact with the holding surface. In other words, only one coin, even having the smallest diameter, can be in surface contact with the holding surface defined by the pusher of the rotary disk.

The coin in surface contact with the holding surface and being pushed by the pusher cannot pass through coins in a bulk state as long as the coin is at least above a horizontal line passing through a rotation axis center of the rotary disk.

Since the height of the pusher is equal to or lower than the coin having the thinnest thickness, if two coins having the thinnest thickness are stacked, the upper coin will not be supported by the pusher and will fall downward by gravitation force into the storing container at a lower place.

That is, above the horizontal line passing through the rotation axis line of the rotary disk, only one coin having the smallest diameter is held as being in contact with the holding surface defined by the pusher, and can be moved together with the rotation of the rotary disk.

The coin in surface contact with the holding surface of the rotary disk will slip downward by self weight at approximately a 2 o'clock position as likened to an hour dial face of a clock, and the lower perimeter surface is supported by the coin support ledge of the circumferential-direction guiding part. Regarding the projection amount of this circumferential-direction guiding part from the holding surface of the rotary disk, since at least the coin support ledge by which the coin is supported is lower than the thickness of the coin having the thinnest thickness, two coins cannot be supported in a stack configuration.

The coin supported by the coin support ledge is continuously pushed by the pusher to be moved in the circumferential direction of the rotary disk along a circumferential-direction guiding part.

The coin being pushed by the pusher and moved along the circumferential-direction guiding part is shifted to a horizontal direction with respect to the pusher, in other words, to a peripheral edge side of the rotary disk, to be in contact with the holding edge.

The holding edge is formed to have an approximately constant radius from the axial center of the rotary disk. Therefore, even when the rotary disk rotates, the coin is in a stationary state at an approximately constant position in contact with the circumferential-direction guiding part and the holding edge. This stationary position is the final delivery position from the rotary disk.

To this delivery position, the rotary transferring body will rotate. Therefore, the coin is pushed by the rotary transferring body along the circumferential-direction guiding part to be moved to the sensor part. Thus, since the coin in the stationary state is pushed by the rotary transferring body, a transfer can be smoothly performed, and no jamming or like the occurs with the coins. Note, as the contact surface of the pushing and coin is relatively moving the coin can rotate at the stationary position until removed by the rotary transferring body.

In a modification, the pusher has a rotation rear side that is continuous to a holding edge formed on an inclined surface sequentially away from the upper surface from an outer perimeter surface side toward the rotation axis line side of the rotary disk.

With this structure, when the inclined surface is positioned above the rotation axis of the rotary disk, the inclined surface is oriented downward. Therefore, a coin with its lower end mounted on the downward-oriented inclined surface will slip downward from the inclined surface. In other words, since the coin cannot be mounted on the pusher unit on the rotation rear side of the holding edge, only one coin is advantageously delivered to the rotary transferring body.

When the pusher unit includes a first pusher positioned a predetermined first distance away from the rotation center of the rotary disk and a second pusher is positioned a second distance larger than the first distance away therefrom and, when a coin having a smallest diameter is supported in the coin support ledge, the first pusher pushes a perimeter surface closer to the rotation center than a center of the smallest diameter.

With this structure, the first pusher pushes the perimeter surface of the coin having the smallest diameter facing the support ledge, in other words, a downward-oriented perimeter surface. With this, the downward-oriented perimeter surface receives a force pushed from the first pusher, in a direction of being away from the support ledge. Then, in the course of the coin being guided by the circumferential-direction guiding part to move to the circumferential direction of the rotary disk, the coin is pushed by the second pusher, and is eventually held by the holding edge at a predetermined position.

When a large-diameter coin is supported by the support ledge, the side perimeter surface, that is, a portion near an arc line with a distance from the rotation axis center of the rotary disk to the center of the coin as a radius, the coin is pushed by the second pusher, and the coin is eventually supported by the support ledge formed in the second pusher.

With this, even if a difference in diameter between the coin having a minimum diameter and the coin having a largest diameter is large, the coin can be advantageously moved smoothly and reliably along the circumferential-direction guiding part.

The second pusher can be placed so as to push at least the coin moved by the first pusher along the circumferential-direction guiding part in the circumferential direction of the rotary disk. With this structure, the coin having the lower perimeter surface pushed by the first pusher and being moved along the circumferential-direction guiding part is moved in the circumferential direction of the rotary disk. Therefore, the lower perimeter surface is moved as being pushed by the second pusher to be guided to the circumferential-direction guiding part, and is eventually held by the holding edge at a predetermined position.

Therefore, the coin is moved when a lower perimeter coin surface is pushed by the first pusher or the second pusher. Therefore, the coin is moved while receiving a force oriented upward from below, in other words, a force in a direction of being floated from the circumferential-direction guiding part. Thus, the coin can be advantageously moved smoothly and reliably.

The second pusher can have a rotation rear side continuous to the holding edge formed on an inclined surface sequentially away from the upper surface from an outer perimeter surface side toward the rotation axis side of the rotary disk. In this structure, when the inclined surface of the second pusher is positioned above the rotation axis of the rotary disk, the inclined surface is oriented downward. Therefore, any coin with its lower end mounted on the downward-oriented inclined surface will slip down from the inclined surface. In other words, since the coin cannot be mounted on the pusher on the rotation rear side of the holding edge, two coins cannot be simultaneously received by the rotary transferring body. With this, advantageously, two coins in a stack cannot be received.

Since most of the coins are made of metal, when a pusher unit is molded by using resin, a difference in hardness can be relatively large, and the pusher unit can wear early due to multiple contacts with the coins, and durability can be problematic. However, with a pusher unit made of metal, a small difference in hardness or a larger hardness than that of the coins can be achieved. Therefore, it is advantageous to suppress wear and improve durability by having a pusher unit formed of metal.

The pusher unit can be configured of divided pushers obtained by plural divisions in a circumferential direction, the divided pushers can individually go forward and backward with respect to the upper surface of the rotary disk, and the divided pushers can each individually sink toward the upper surface of the rotary disk when facing the circumferential-direction guiding part and project from the upper surface when positioned otherwise.

In this structure, the pusher unit can make a retreating movement into the rotary disk at a position facing the circumferential-direction guiding part. In other words, a groove through which the pusher unit passes is not required to be formed in the circumferential-direction guiding part. Thus, advantageously, manufacture of the circumferential-direction guiding part can be facilitated at a low cost.

The coin separating and transferring apparatus has an advantage of being capable of separating coins one by one and reliably transferring each one to a rotating transferring body.

The coin separating and transferring apparatus further has an advantage of being capable of smoothly and reliably moving coins along the circumferential-direction guiding part even if a difference in diameter between a coin having a smallest diameter and a coin having a largest diameter is large.

The coin separating and transferring apparatus further has an advantage of inexpensive manufacturing in a compact small size.

The coin separating and transferring apparatus has an advantage of smoothly and reliably moving coins.

The coin separating and transferring apparatus further has an advantage of preventing two coins from being simultaneously received by a rotary transferring body.

The coin separating and transferring apparatus further has an advantage of improving durability.

The coin separating and transferring apparatus further has an advantage of being manufactured inexpensively.

A coin separating and transferring apparatus includes a storage container for storing bulk coins and a rotating disk mounted for rotation about a rotational axis to contact any bulk coins in the storage container, the rotary disk is mounted at an angle to gravitational forces to enable a sliding movement of coins on the rotary disk. A pusher unit is connected to a surface on the rotary disk for contacting and moving coins on the rotary disk. A guiding member is positioned to extend across a portion of the rotary disk and to direct coins for release from the rotary disk and includes a coin support ledge positioned above the slanted rotary disk rotational axis and extending to a delivery support ledge which provides a stationary coin position prior to the coin release from the rotary disk. The pusher unit will separate a coin from the stored bulk coins and position the separated coin on the coin support ledge, for movement along the guiding member to the stationary coin position, the pusher unit supporting the separated coin at the stationary coin position until removed from the rotary disk.

A rotary transferring unit is aligned with the stationary coin position to contact and transfer the stationary coin from the rotary disk, and a sensor for measuring a property of the coin is operatively positioned in the rotary transferring unit.

The pusher unit can include a first pusher positioned a first distance away from the rotational axis and a second pusher positioned a second distance away from the rotational axis, which is larger than the first distance, wherein when a coin having the smallest diameter of the bulk coins is supported on the coin support ledge, the first pusher is configured to push a perimeter surface of the coin closer to the rotational axis than a center of the coin. The second pusher is configured to also push the smallest diameter coin along the guiding member in a circumferential direction of rotation of the rotary disk. The second pusher has an inclined surface, from a rear side of the second pusher relative to a second holding edge, that extends downward towards an upper surface of the rotary disk adjacent the second holding edge.

The pusher unit can be configured of a plurality of pushers that are mounted on the rotary disk to be biased above the surface of the rotary disk and configured to be forced downward when contacting the guiding member.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
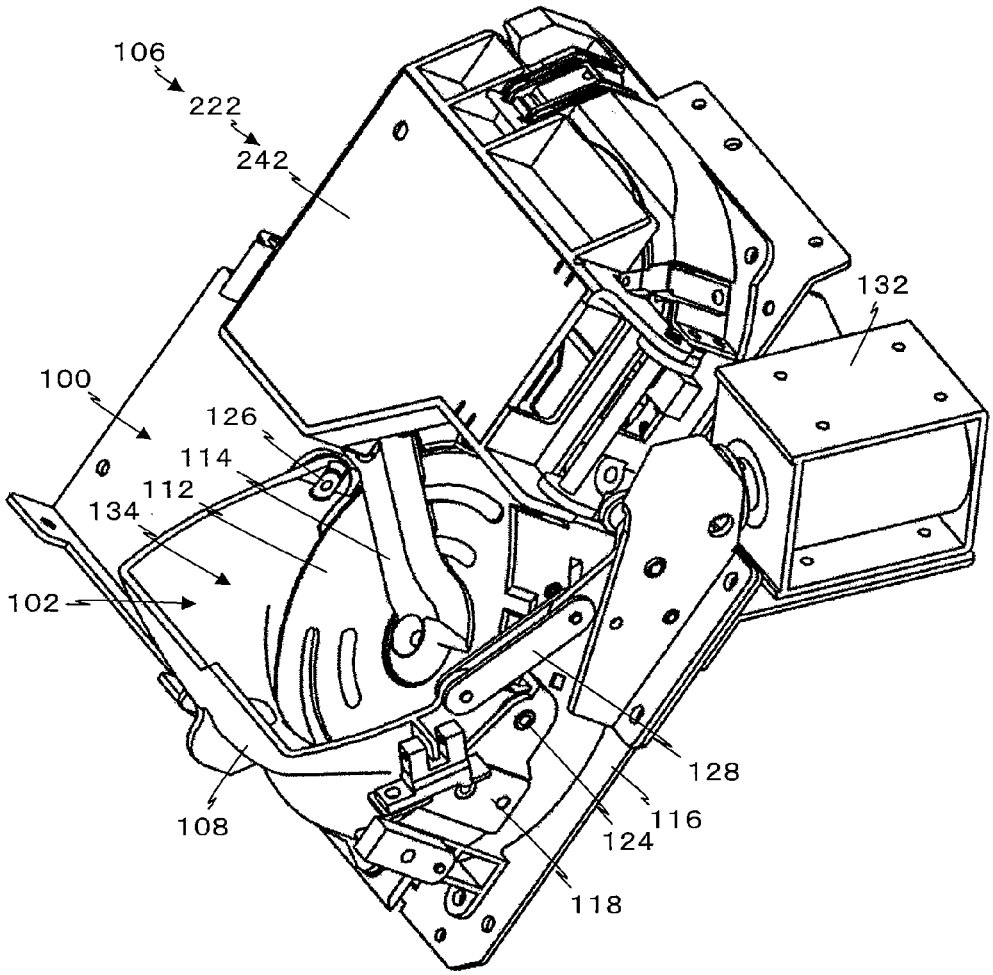
FIG. 1 is a perspective view of a coin separating and transferring apparatus of a first embodiment of the present invention.

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

To reduce cost, adoption of the following disclosed in the second conventional technology was considered with a rotating tilted disk, a support ledge formed on an upper surface of the tilted disk, the reservoir hopper frame, the plurality of scraping projections, an outer perimeter projection supporting two points of each of the coins in the lower area of the tilted disk in cooperation with the corresponding scraping projection in an outer perimeter area of these scraping projections and scraping the coin toward the upper area of the tilted disk, and a mechanism picking up the coin scraped by the scraping projection and the outer perimeter projection by using a throwing member provided in a cantilever fixed state with respect to the tilted disk and extending in a circumferential direction, and then delivering the coin to a conveyor belt.

However, if a modification of the second conventional technology is adopted, assembling has to be such that a gap between the tilted disk and the throwing member is smaller than the thickness of a thinnest coin and a gap between the tip of the throwing member and a support plate is as small as possible. It is not easy to adjust this assembling relationship to be within a predetermined range and, as a result, the cost cannot be reduced and thus this technology cannot be adopted.

Thus to facilitate adjustment of the positional relation between the tilted disk and the throwing member, replacing the boundary periphery part and the throwing member of the second conventional technology by a fixed shelfwheel and the fixed knife disclosed in the second conventional technology was considered.

In this case, when a coin is pushed by the scraping projection to be moved along the throwing member and then the coin linearly moving as being guided by the throwing member is nipped by an endless conveyor belt, the coin may be delivered to the conveyor belt without any problem.

However, when a coin is delivered to the rotating coin transferring body and a sensor part is moved by the rotating coin transferring body, the direction in which the coin is pushed by the rotating pusher onto the throwing member is relatively large, and a coin may jump from the throwing member in reaction to an impact on the throwing member and not move along the throwing member. For this reason, the sensor part is not allowed to be placed near the throwing member. To solve this, the sensor part has to be placed on a route along the throwing member after jumping so as to be able to correctly detect physical properties of the coin even if the coin jumps, disadvantageously resulting in a large size.

Moreover, while it can be thought that the scraping projections in the second conventional technology are placed as disclosed in the fourth conventional technology, the direction of the force for pushing the coin onto the throwing member by the rotating coin transferring body is not improved, and a problem similar to the above is present.

The present invention relates to a small-sized coin separating and transferring apparatus for receiving coins of a plurality of denominations one by one in a holding part formed on an upper surface of a rotary disk, sorting them, then guiding them to a next process stage along a circumferential-direction guiding body placed in a state of being fixed to the rotary disk, where the individual coin is maintained at a stationary position, and then further transferring the guided coin by a rotary transferring body along a sensor guide.

Note that the term "coins" as use in this specification include coins as currencies, tokens, medals, and others, and their shapes may include a circle and a polygon.

The present invention is directed to a coin separating and transferring apparatus including a rotary disk having at least a lower-side portion slantly placed on a bottom part of a storing container capable of storing coins in a bulk state. The apparatus having formed therein a pusher unit such as a plurality of pushers projecting from an upper surface of the rotary disk and having a projection amount smaller than a thickness of a coin having a thinnest thickness. The coins are individually pushed by the pusher units to be moved along a surface of a circumferential-direction guiding part extending from a center part of the rotary disk to a circumferential direction and provided in a fixed state. The coins are then guided by a rotary transferring body rotating about an axial center to the circumferential-direction guiding part which positions the coin in order to be moved to a sensor part for determining characterization of the coin.

A coin support ledge is formed on an upper side of the upper surface with a predetermined radius concentric with respect to a rotation axis of the rotary disk and continuous to a ledge of the circumferential-direction guiding part. The pusher unit is placed to project in a rib or arc shape with respect to the upper surface and is formed to have a length substantially longer than a diameter of a coin having a largest diameter and, at least each of pushers have a holding edge formed on a rear side relative to a rotating direction. The holding edge has a predetermined radius from the rotation axis center of the rotary disk and a predetermined length.

The pusher unit can include a first pusher positioned at a predetermined first distance away from the rotation axis center of the rotary disk and a second pusher positioned at a second distance larger than the first distance away from the axis center. When a coin having a smallest diameter is supported on the coin support ledge, the first pusher pushes a perimeter surface closer to the rotation center than a center of the smallest diameter. A portion of the first pusher and the second pusher that is designed to be in contact with the coins is made of metal.

The first pusher has a rotation rear side that is continuous to the holding edge and further formed on an inclined surface sequentially away from the upper surface from an outer perimeter surface side toward the rotation axis line side of the rotary disk. The coins supported in a stationary state at a delivery position between the circumferential-direction guiding body and the holding edge are pushed or agitated by the rotary transferring body.

A first embodiment of the invention relates to a coin separating and transferring apparatus for processing coins of size denominations of Japanese currency, that is, a 1-yen coin made of aluminum and having a diameter of 20 millimeters, a 5-yen coin made of brass and having a diameter of 22 millimeters, a 10-yen coin made of bronze and having a diameter of 23.5 millimeters, a 50-yen coin made of nickel and having a diameter of 21 millimeters, a 100-yen coin made of nickel and having a diameter of 22.6 millimeters, and a 500-yen coin made of nickel brass and having a diameter of 26.5 millimeters.

The coin separating and transferring apparatus 100 of the first embodiment has a function of separating coins of 1-yen to 500-yen stored in a bulk state one by one and transferring the coins to a predetermined direction one by one with spaces therebetween.

In other words, the coin separating and transferring apparatus 100 of the first embodiment relates to a coin separating and transferring apparatus capable of sorting coins of a plurality of denominations having different diameters in a bulk state stored in a storing container 108, sending the coins in a predetermined direction with respect to a rotary disk 112, and smoothly delivering the sent coins one by one to a rotating rotary transferring body 224.

Figure 2:
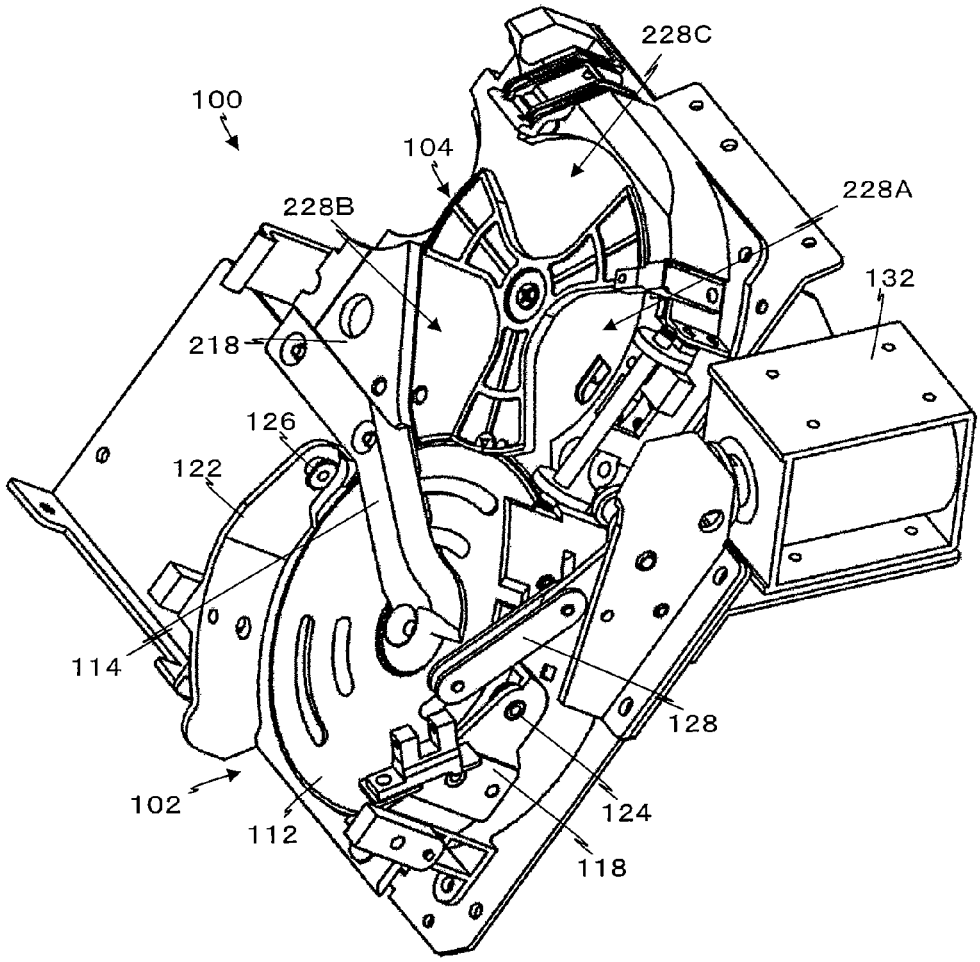
FIG. 2 is a perspective view of the coin separating and transferring apparatus of the first embodiment of the present invention with the storing container and an upper-side sensor body being removed therefrom.

In FIG. 1 and FIG. 2, the coin separating and transferring apparatus 100 broadly includes a coin sending device 102, a coin transferring device 104, and a coin discriminating device 106.

That is, the coin separating and transferring apparatus 100 causes coins C to be sorted one by one and sent by the coin sending device 102 to be delivered to the coin transferring device 104 and, in the course of transferring the coin along a predetermined route by the coin transferring device 104, physical properties of the coin are obtained by the coin discriminating device 106 to determine the status of the coin.

First, the structure of the coin sending device 102 is described with reference to FIG. 1 to FIG. 9. The coin sending device 102 has a function of sorting the coins C of a plurality of denominations stored in a bulk state one by one and sending the coins one by one to a predetermined direction.

The coin sending device 102 includes a storing container 108, a rotary disk 112, and a circumferential-direction guiding body 114.

Figure 6:
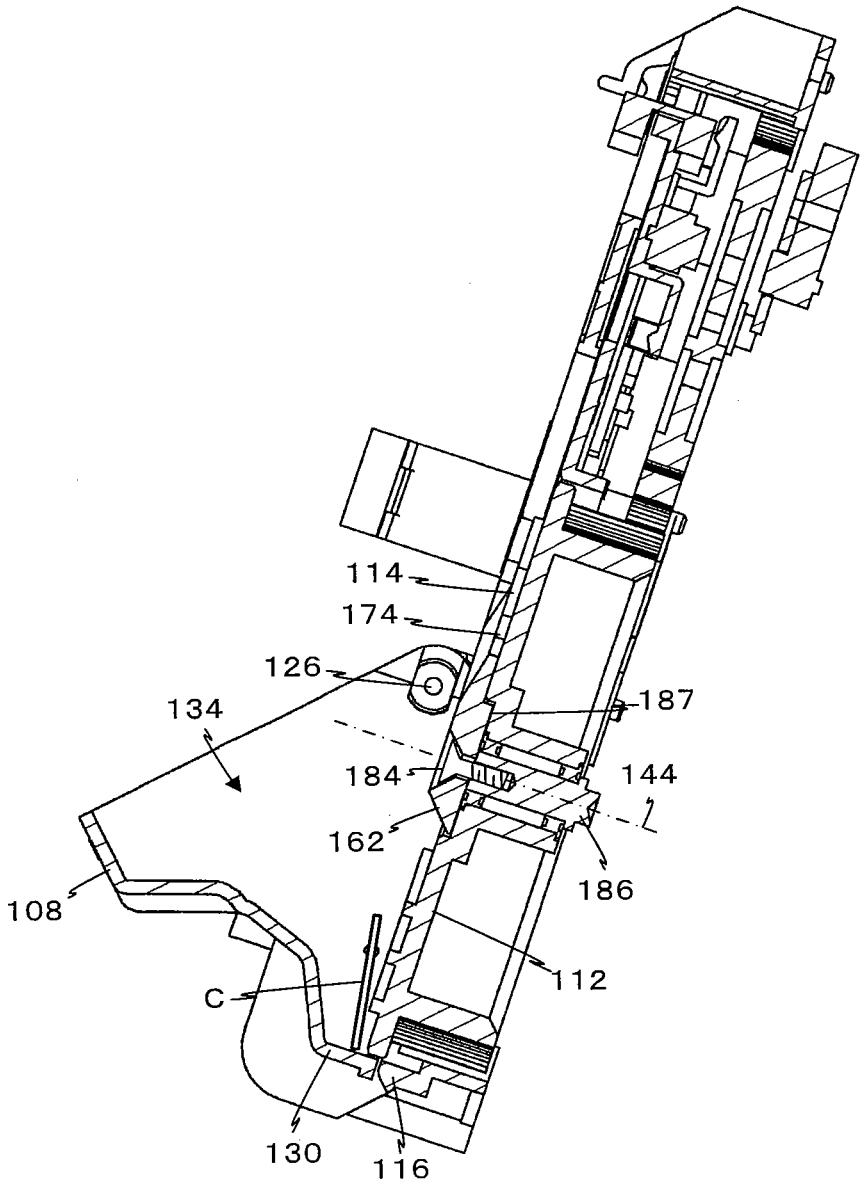
FIG. 6 is a sectional view obtained by cutting along a plane passing through a rotation axis center of the rotary disk in the coin separating and transferring apparatus of the first embodiment of the present invention.

The storing container 108 can be described with reference to FIG. 1 and FIG. 6. The storing container 108 has a function of storing the coins C in a bulk state at a front portion of the rotary disk 112. The storing container 108 can have a tub shape with its end, on a rotary disk 112 side, being formed in a semicircular shape.

The storing container 108 has an upper end of a semicircular shape which is inserted between a right column 118 and a left column 122, that are fixed on a base 116 with a predetermined space so as to hold the rotary disk 112 on an upward-oriented surface of a base 116 having the shape of a rectangular plate slantly placed. The storing container 108 is rotatably supported by a right spindle 124 and a left spindle 126 horizontally projecting from the right column 118 and the left column 122 so as to face each other, as shown in FIG. 1.

The storing container 108 is coupled to an iron core of an electromagnetic actuator 132 via a link 128 on a side of the right spindle 124. When the electromagnetic actuator 132 is demagnetized, an end of the semicircular end 130 (refer to FIG. 6) of the storing container 108 is pressure-contacted with the upper surface of the base 116 via a spring (not shown) acting on the iron core. In other words, the storing or storage container 108 forms a storing chamber 134 in an inverted-triangular shape for the bulk coins C at a front portion of the rotary disk 112.

When the electromagnetic actuator 132 is magnetized, the storing container 108 is rotated in a clockwise direction in FIG. 1 about the right spindle 124 and the left spindle 126 via the link 128. With this, a semicircular end 130 of the storing container 108 goes away from the base 116 to form a gap with respect to the base 116. Via this gap, foreign substances such as dust residing in the storing chamber 134 are eliminated.

When elimination of foreign substances from the storing chamber 134 ends, the electromagnetic actuator 132 is demagnetized, and the semicircular end 130 of the storing container 108 is pressed onto the base 116 by an elastic force of the spring (not shown).

When a rotation force to a clockwise direction is received by the storing container 108 from the coins C, the storing container 108 is self-locked by a self-lock mechanism incorporated in the link 128, and therefore the semicircular end 130 is configured substantially not to move away from the base 116.

Next, the rotary disk 112 is described with reference to FIG. 3 to FIG. 6.

The rotary disk 112 has a function of mixing the coins C stored in a bulk state in the storing chamber 134 and receiving the coins C one by one in a holding part 148, which will be described further below, for sorting and providing a function of transferring the received coins C to a rotating direction.

The rotary disk 112 has a disk shape having a predetermined thickness, and has an upper surface 136 of an approximately flat shape formed thereon and a driven gear 142 formed on a perimeter surface which can mesh with a driven gear activated by a motor (not shown).

The rotary disk 112 is placed on the upward-oriented surface side of the base 116, and its rotation axis line 144 is tilted at a predetermined angle. A lower portion of the upper surface 136 is placed adjacently to a semicircular opening of the storing container 108 to form a bottom surface of the storing chamber 134.

The storing chamber 134 has a space in the form of an approximately downward-oriented triangle surrounded by the upper surface 136 of the rotary disk 112 and the storing container 108. Therefore, the lower portion of the upper surface 136 of the rotary disk 112 forms a bottom wall (a side wall) of the storing chamber 134, and is in contact with the coins C in the storing chamber 134.

On the upper surface 136 of the rotary disk 112, pusher units 146 are formed so as to protrude above the surface of the rotary disk 117, and a holding part 148 for coins is defined and formed by the pusher units 146 and the upper surface 136. The pusher units 146 mainly have a function of mixing the coins C in the storing chamber 134 and pushing the coins C obtained by sorting the coins one by one.

In the first embodiment, the pusher units 146 are configured of a first pusher 152 and a second pusher 154, and three sets of one first pusher 152 and one second pusher 154 are provided. However, depending on the difference in the diameter of the target coins, the pusher units 146 may include only the second pusher 154 shown in the first embodiment. In other words, the number of pushers may be one.

Also, the number of sets of the first pusher 152 and the second pusher 154 may not be three, but can be one, two, or four or more. When the number of sets is only one or two, the size of the rotary disk 112 can be advantageously made small, but the number of processes per unit time is small.

By contrast, when the number of sets is four or more, while the number of processes per unit time is increased, the diameter of the rotary disk 112 is increased, thereby disadvantageously increasing the size of the apparatus. Thus, in view of the number of processes per unit time and a decrease in size, the set of the first pusher 152 and the second pusher 154 is preferably three.

Figure 4:
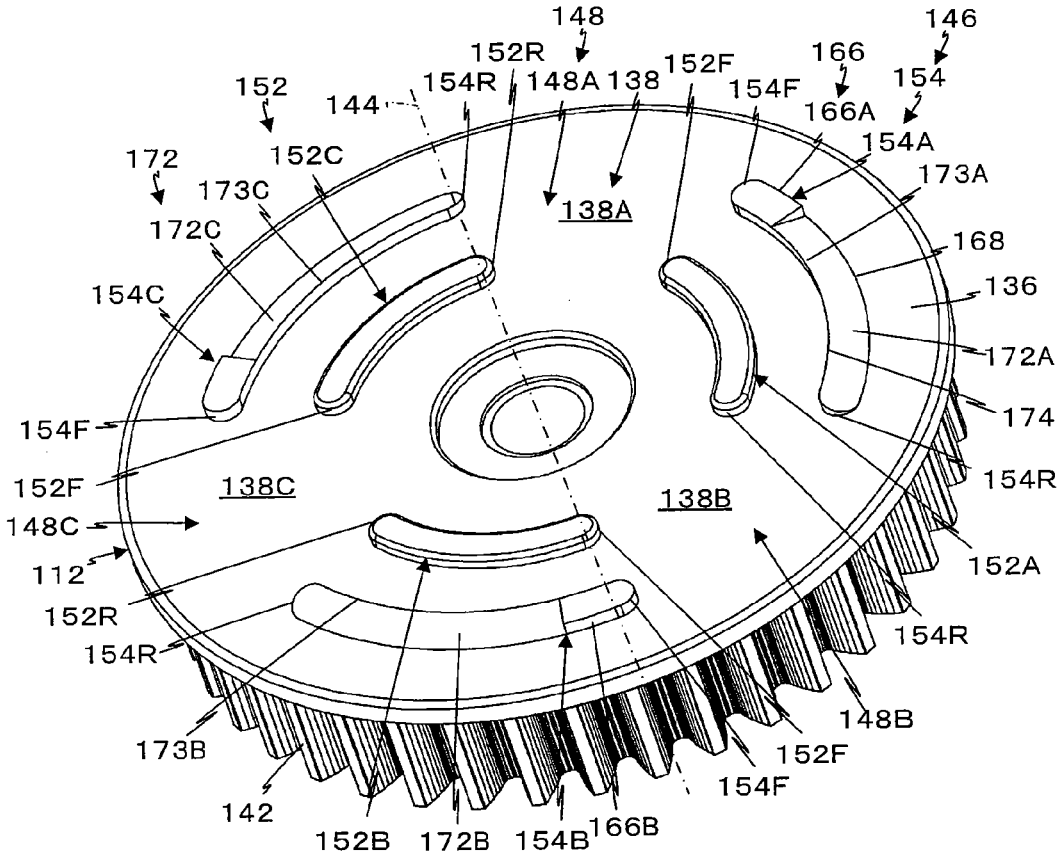
FIG. 4 is a perspective view of a rotary disk in the coin separating and transferring apparatus of the first embodiment of the present invention.
Figure 5:
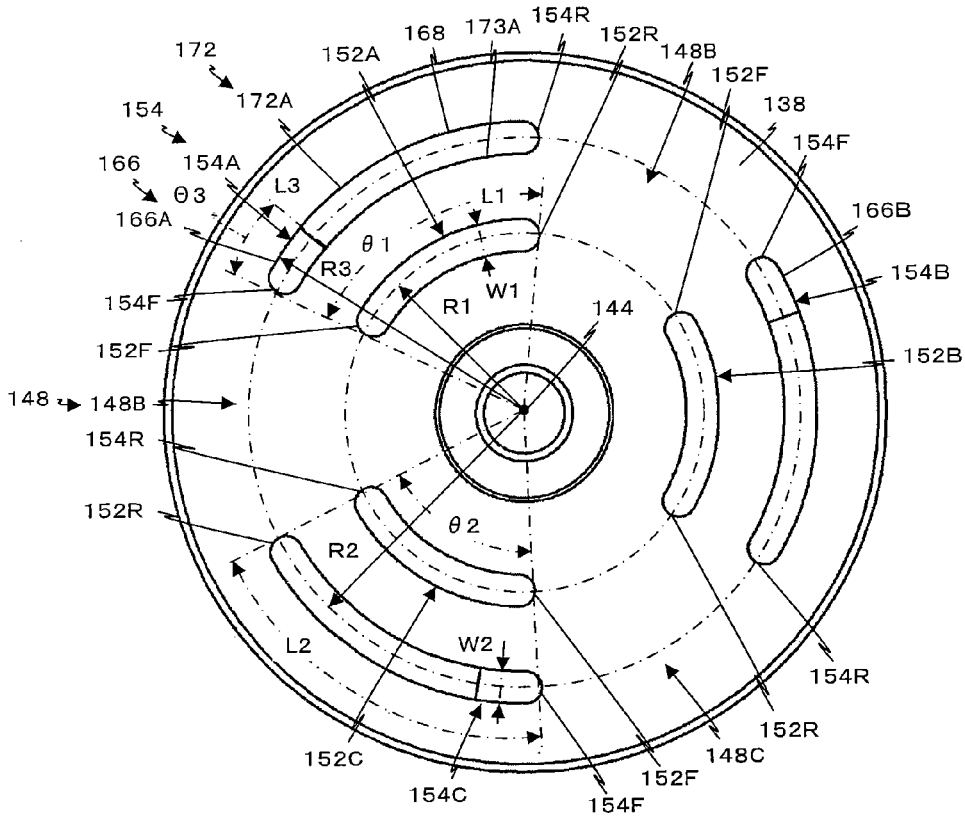
FIG. 5 shows a plan view (A) and a front view (B) of the rotary disk in the coin separating and transferring apparatus of the first embodiment of the present invention.
Figure 5:
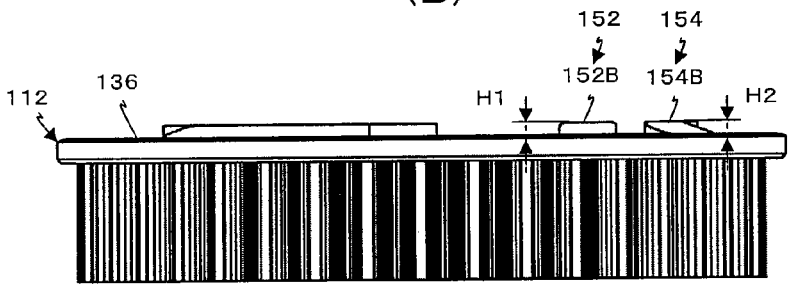

The first pusher 152 is described mainly with reference to FIG. 4 and FIG. 5.

The first pusher 152 mainly has a function of first pushing a coin having a small diameter SC (in the first embodiment a 1-yen coin 1C) supported by the fixed support ledge 174, which will be described further below. The first pusher 152 has an arc-shaped projecting line projecting in a rib shape at a predetermined first radius R1 (a first distance L1) with a rotation axis line 144 of the rotary disk 112 as a center, the first pusher having a predetermined first width W1 at a predetermined first angle θ1.

Although at least one first pusher 152 can be used, a plurality of first pushers is preferably provided in order to improve the speed for processing the coins C. In the first embodiment, three first pushers 152A, 152B, and 152C are formed in the same shape and equally spaced apart from each other. In the following, these pushers are referred to as the first pusher 152 unless further description is required. The same goes for cases other than the first pusher 152.

The "rib shape" means that an elevated "mountain range" with a predetermined height and length is provided. For example, even if there is a difference in height or the mountain-range-shaped projecting line is divided into plural, this shape corresponds to the "rib shape" in the present invention as long as operations and effects similar to those of the case of an integral shape can be achieved.

Since the first pushers 152A, 152B, and 152C all have the same shape, the first pusher 152A is representatively described. The first pusher 152A projects with respect to the upper surface 136 of the rotary disk 112 with a predetermined first height H1 (FIG. 5(B)). The predetermined height is substantially 1.5 millimeters, which is a thickness of the thinnest coins, that is, a 1-yen coin and 5-yen coin in the first embodiment, or smaller. "Substantially" means that, with one thinnest coin C in surface contact with the upper surface 136 having another coin C stacked thereon, the upper coin C is not pushed. For example, in the first embodiment, even if the height exceeds 1.5 millimeters, the end is beveled and therefore the upper coin C is not pushed, combined with the roundness of the perimeter of the coin C.

However, the height H1 of the first pusher 152A is preferably thinner than the thickness of the thinnest coin C also in a physical sense. The reason for this is that the upper stacked coin C is not pushed even if an incidental adhesive fluid or the like is attached to the coin C.

The first width W1 of the first pusher 152 is preferably as narrow as possible. The reason for this is that the width of a first passage groove 158, provided on the rear surface of the circumferential-direction guiding body 114 can be narrowed and therefore any decrease in strength in the circumferential-direction guiding body 114 can be suppressed.

A front end 152F of the first pusher 152 on a front side in the rotating direction and a rear end 152R on a rear side are preferably each formed in a semicircular shape. The reason for this is that sliding resistance can be prevented when a pusher slides on a perimeter surface of the coin C.

The first angle θ1 (for convenience, the first length L1) at which the first pusher 152 is formed is set so that the first length L1 of the first pusher 152 is longer than a portion of a coin having a largest diameter LC when the coin having the largest diameter LC is stored. The reason for this is that the coins C are reliably sorted one by one.

Next, the second pusher 154 is described. The second pusher 154 has a function of continuously pushing a coin having a small diameter SC that was pushed by the first pusher 152, mainly along the coin having the largest diameter LC and the circumferential-direction guiding body 114.

The second pusher 154 has an arc-shaped projecting line projected in a rib shape having a predetermined second width W2 and at a predetermined second angle θ2 at a predetermined second radius R2 (a second distance L2) larger than the first radius R1 centering on the rotation axis line 144. In the first embodiment, while the second angle θ2 is smaller than the first angle θ1, the second pushers 154 can be provided in the same number as the first pushers 152. The reason for this is that with these first pushers 152, the second pushers 154, and the support ledge 174 and the upper surface 136, which will be described further below, the holding surface 138 of the coin C is defined. Therefore, if the number of pushers 146 is one, the pusher 146 and the support ledge 174 and the upper surface 136 define the holding surface 138.

Second pushers 154A, 154B, and 154C all have the same shape. The second pusher 154A projects upward so as to have a predetermined second height H2 with respect to the upper surface 136. The predetermined second height H2 is set based on the same concept as that for the first pusher 152. In the first embodiment, the first height H1 of the first pusher 152 and the second height H2 of the second pusher 154 are equal to each other. However, the second height H2 of the second pusher 154 can be lower than or higher than the first height H1.

The second width W2 of the second pusher 154 is preferably as narrow as possible. The reason for this is that the width of a second passage groove 160 provided on the rear surface of the circumferential-direction guiding body 114 can be narrowed and therefore a further decrease in the structural design strength of the circumferential-direction guiding body 114 can be suppressed.

A front end 154F on a front side and a rear end 154R on a rear side in the rotating direction of the first pusher 152 are preferably each formed in a semicircular shape. The reason for this is that sliding resistance can be small when the pushers slide on a perimeter surface of the coin C which is small.

The second angle θ2 (for convenience, the second length (L2)) with which the second pusher 154 is formed is set so that the second length L2 of the second pusher 154 is longer than a facing portion of the coin having the largest diameter LC when the coin having the largest diameter LC is mounted on the second pusher 154.

Next, a holding ledge 166 is described. The holding ledge 166 has a function such that a coin C moved by the second pusher 154 in the circumferential direction of the rotary disk 112, along the circumferential-direction guiding body 114, is supported by the holding ledge 166 and the circumferential-direction guiding body 114 to be in a stationary state at a delivery position DP.

The holding ledge 166 is an outer perimeter edge formed at a predetermined third angle θ3 (a third length L3) with a predetermined third radius R3 connecting to the front end 154F on the front side in the rotating direction of the second pusher 154. In other words, holding ledges 166A, 166B, and 166C are provided for respective second pushers 154A, 154B, and 154C (see FIG. 5A).

Since the holding ledges 166A, 166B, and 166C have the same structure, only the holding ledge 166A is representatively described. The holding ledge 166A has an arc-shaped projection formed with a third radius R3 centering on the rotation axis line 144 at the third angle θ3 (with the third length L3).

The third radius R3 and the third length L3 forming the holding ledge 166A are appropriately set so that a transfer of the coins C by the coin transferring device 104 can be started in relation to the coin transferring device 104. Therefore, the holding ledge 166 is not required to be formed over the entire length with the third radius R3 centering on the rotation axis line 144. For example, the holding edge may be formed so as to be away from the rotation axis line 144 as it goes to the rear side of rotation from the front side 154F.

In the first embodiment, the holding ledge 166A has a height equal to the second height H2 (see FIG. 5B).

The outer perimeter edge 168 of the second pusher 154 connecting the rear side of the rotating direction of the rotary disk 112 with respect to the holding ledge 166A is positioned on the same plane as the upper surface 136.

The second pusher 154 is formed on a first inclined surface 172 (172A) ascending from the outer perimeter edge 168 toward the rotation axis line 144 in the range of the second width W2. An inner perimeter edge 173A of the second pusher 154A is formed to have a height equal to the second height H2. Therefore, when a movement is made upward from the rotation axis line 144, the first inclined surface 172A is a front-descending inclined surface oriented downward, and the coin C mounted thereon falls down by its own weight.

In both of the first pusher 152 and the second pusher 154, their front ends 152F and 154F on the front side in the rotating direction are preferably configured of metal. This is to prevent wear due to rubbing with the coins C.

For example, the structure can be made by arranging a metal pin having a crescent shape in a planar view and having its lower end embedded in the rotary disk 112 on the front-side front ends 152F and 154F. With such a metal pin, easy mounting and high wear resistance can be achieved. Also, with the pusher including the holding ledge 166 made of metal, wear resistance can be further improved.

Next, the holding part 148 is described mainly with reference to FIG. 4 and FIG. 5. The holding part 148 has a function of sorting the coins C one by one so that only one coin C can be in surface contact. In other words, the pushers 146 and tip parts 162 are arranged so as to have dimensions not allowing two coins having the smallest diameter SC to be in surface contact.

Figure 3:
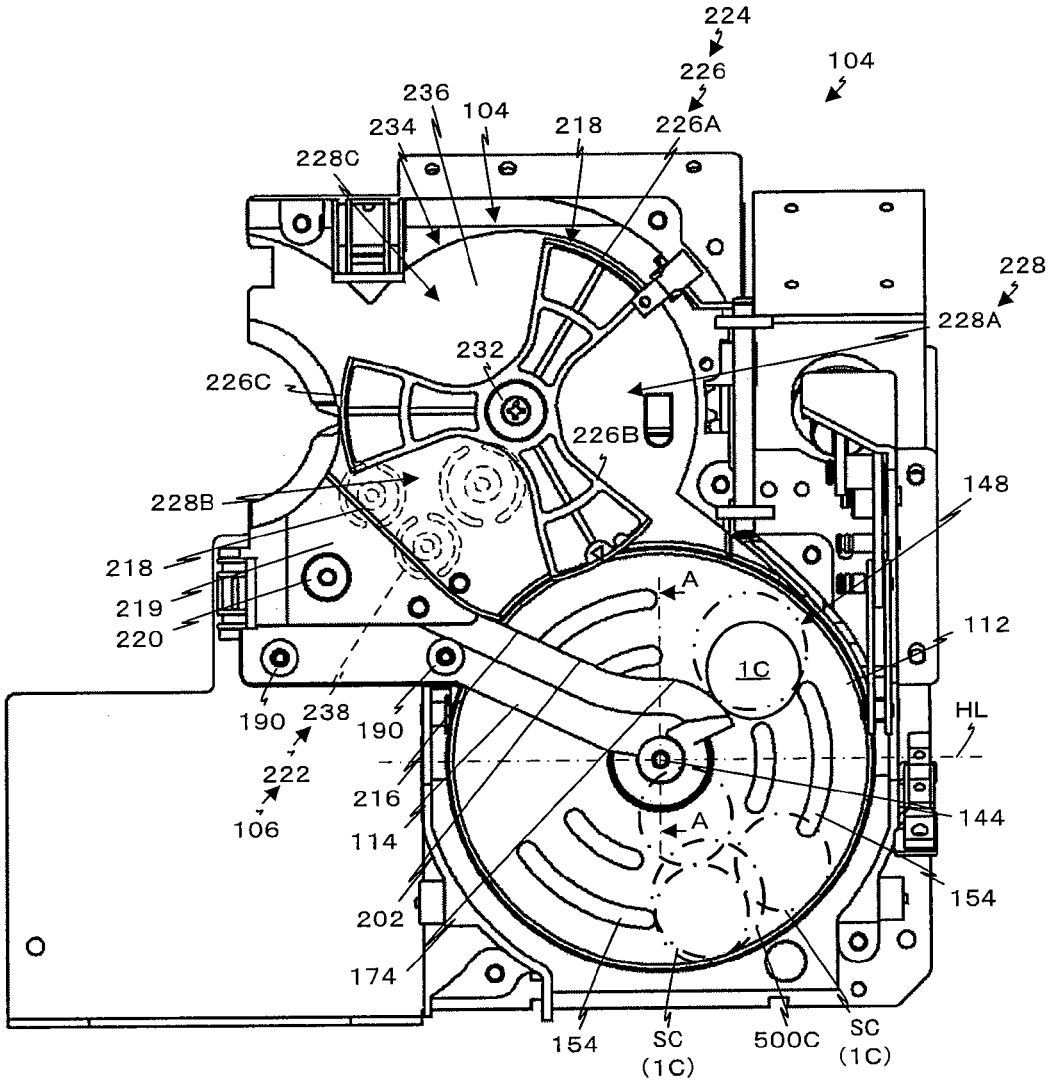
FIG. 3 is a front view of the coin separating and transferring apparatus of the first embodiment of the present invention with the storing container and an upper-side sensor body being removed therefrom.

As evident in FIGS. 3 and 4, the holding part 148 is a flat area surrounded by the pushers 146 (the first pusher 152 and the second pusher 154), the support ledge 174 or the semicircular end 130 of the storing container 108, and the holding surface 138 of the rotary disk 112 in an approximately fan shape.

In the first embodiment, three holding parts 148A, 148B, and 148C are formed in an equidistant (equiangular) manner. When the holding parts 148A, 148B, and 148C face the storing container 108, in other words, when they are positioned lower than the rotation axis line 144, in these holding parts 148A, 148B, and 148C, only one coin can be in surface contact with the holding part 148 surrounded by the semicircular end 130 of the storing container 108, the first pusher 152, the second pusher 154, and the circumferential-direction guiding body 114 even in the case of a coin having the smallest diameter SC.

At a position facing the storing chamber 134, if the coin C is not in surface contact with the holding surface 138, the coin C is not pushed by the second pusher 154, and is not moved along the inner surface of the semicircular end 130.

The rotary disk 112 is rotated by an electric motor, not shown, at a predetermined speed at a normal time in a counterclockwise direction in FIG. 3. If required, for example, an increase in rotation load of the electric motor is discriminated based on an increase in value of current flowing through the electric motor or a rotation speed. When the rotation load is equal to or larger than a predetermined value, the electric motor can be rotated in reverse (in a clockwise direction in FIG. 3).

In other words, when the rotation load of the rotary disk 112 is increased, it is estimated that the coin C is jammed between the rotary disk 112 and another member to stop the rotation of the rotary disk 112, thereby allowing the rotary disk 112 to be automatically rotated in reverse to automatically release the jamming of the coin C.

Next, the circumferential-direction guiding body 114 is described mainly with reference to FIG. 6 to FIG. 9. The circumferential-direction guiding body 114 has a function of engaging a coin C, held by the holding part 148 and pushed by the pushers 146, and inhibiting integral movement of the coin C with the rotary disk 112 to guide the coin C to a circumferential direction of the rotary disk 112.

The circumferential-direction guiding body 114 is approximately in an elongated sticklike shape, and includes a tip part 162 with its tip approximately in a circular shape, a circumferential-direction guiding part 176 connecting to the tip part 162 and extending straight in an upper-left direction toward an approximately 10 o'clock position on a clock in FIG. 3, and a mounting part 180 connecting to the circumferential-direction guiding part 176 and extending straight in a horizontal direction in FIG. 3.

The circumferential-direction guiding part 176 is formed so that its upper end side is thin and a portion from the center to a lower end has a thickness twice to three times thicker than the thickness of the upper end. This is to increase the strength of the circumferential-direction guiding body 114.

The mounting part 180 is formed to have a thickness equal to the thickness of the lower end side of the circumferential-direction guiding part 176.

Figure 9:
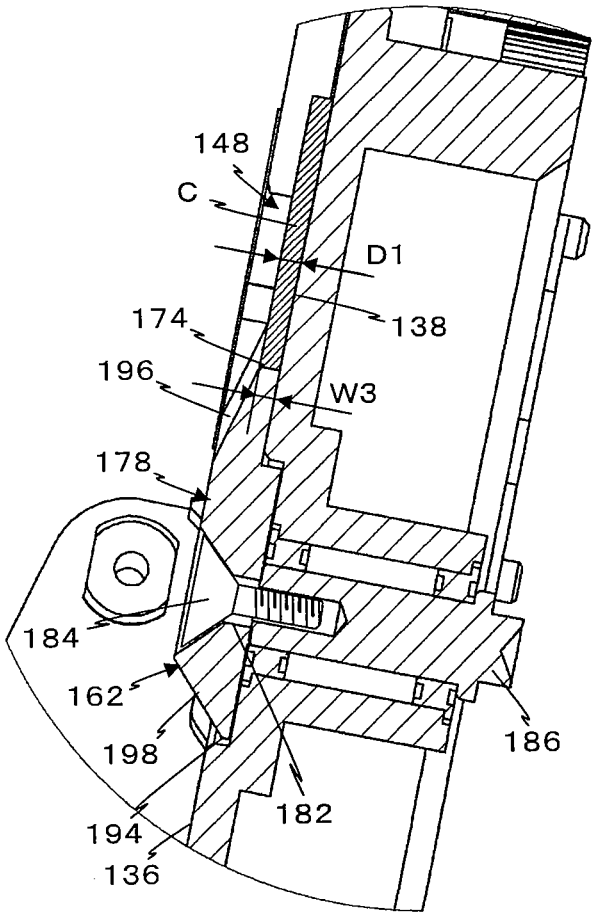
FIG. 9 is a sectional view along an A-A line in FIG. 3.

The tip part 162 of the circumferential-direction guiding body 114 has an outer shape of a truncated cone shape with its center part 178 being made high (thick), has a first through hole 182 formed in the center part 178 letting a countersunk screw 184 penetrate therethrough, which is screwed to a fixed shaft 186 fixed to the base 116 to be fixed to the base 116 (see FIG. 9).

To be fixed to the base 116, a rear-side tip of the tip part 162 is arranged in a circular hole 187 formed about the rotation axis line 144 of the rotary disk 112. The mounting part 180 of the circumferential-direction guiding body 114 is fixed to the base 116 by a screw 190 penetrating through a second through hole 188 on a side of the rotary disk 112 (see FIG. 3).

With the tip part 162 and the mounting part 180 as a base end part being fixed to the base 116 with the countersunk screw 184 and the screw 190, respectively, the strength of the circumferential-direction guiding body 114 can be increased. In addition to metal, resin having a strength lower than that of metal can also be used for manufacture. As a result, it can be advantageous to manufacture at low cost.

The support ledge 174 has a function of guiding the coins pushed by the pushers 146, one by one, to the circumferential-direction guiding part 176. The support ledge 174 is formed on an upper side of the tip part 162 (see FIG. 8).

The tip part 162 has a lower side, from a 2 o'clock to a 10 o'clock position of a clock, formed at a semicircular lower edge 194 with a fourth radius R4. An upper side is formed in a fan shape at an angle of approximately 60 degrees from a 2 o'clock to a 12 o'clock on a clock (FIG. 3) with a fifth radius R5 larger than the fourth radius R4.

An outer perimeter edge of this fifth radius R5 corresponds to the support ledge 174. As evident from FIG. 9, the support ledge 174 forms a right angle with respect to the upper surface 136 (the holding surface 138), and has a width formed so as to be equal to the thickness of the thinnest coin C, that is, the third width W3. In detail, it is set that a first distance D1 (refer to FIG. 9) between the upper surface 136 and the upper surface of the thinnest coin C in surface contact with the upper surface 136 matches with the third width W3 of the support ledge 174 or the third width W3 is slightly smaller than the first distance D1. This is to prevent the two thinnest coins C from being supported by the support ledge 174 in a stacked arrangement.

The support ledge 174 and the center part 178 are formed on a second inclined surface 196. In other words, since the center part 178 is positioned in a lower part of the support ledge 174, the second inclined surface 196 is an inclined surface oriented downward from the support ledge 174 to the center part 178. With this structure, any coin C stacked on another coin C in surface contact with the holding surface 138 is not supported by the support ledge 174 and falls by its own weight onto the second inclined surface 196, and then falls into the storing chamber 134.

A portion between the center part 178 and the lower edge 194 is also connected to a third inclined surface 198. With this arrangement, the third inclined surface 198 goes across an inclined plane where the upper surface 136 is present below the rotation axis line 144, and a coin C is not interposed between the upper surface 136 and the tip part 162.

Figure 11:
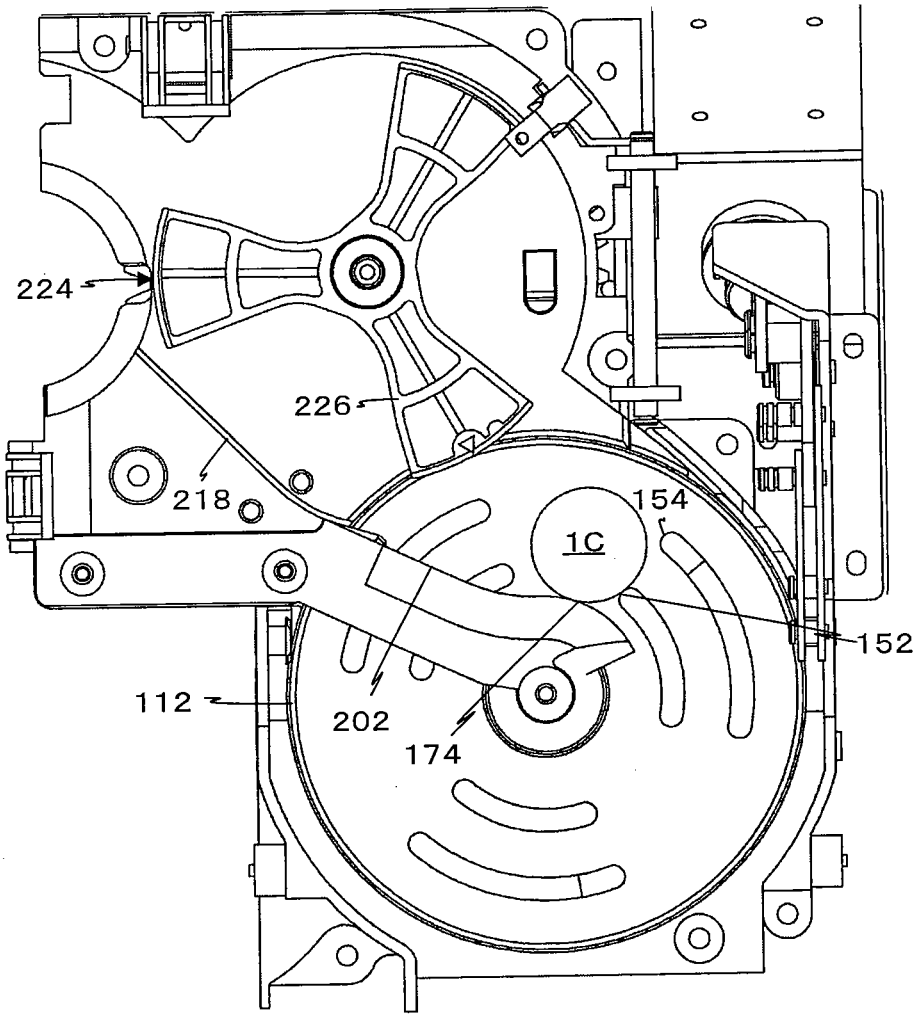
FIG. 11 is a view describing the operation of the coin separating and transferring apparatus of the first embodiment of the present invention (a 1-yen coin supported on a support ledge)

Next, a circumferential-direction guiding ledge 202 is described (see FIG. 11). The circumferential-direction guiding ledge 202 has a function of guiding a coin C supported and guided by the support ledge 174 to a circumferential direction of the rotary disk 112. The circumferential-direction guiding ledge 202 is formed on an upper end face of the circumferential-direction guiding part 176 of the circumferential-direction guiding body 114.

Therefore, the circumferential-direction guiding ledge 202 continues to the support ledge 174, and is inclined straight upward at an angle of 20 degrees to 30 degrees with respect to a horizontal line HL as shown in FIG. 3. The ledge 202 is connected to the support ledge 174 with an arc-shaped smooth curved line. See FIG. 7. The circumferential-direction guiding ledge 202 has a fourth width W4 set equal to the third width W3 of the support ledge 174.

A straight-shaped center part 204 extending in a longitudinal direction of the circumferential-direction guiding part 176 is formed thicker than the circumferential-direction guiding ledge 202, and thus a portion from the circumferential-direction guiding ledge 202 to the straight-shaped center portion 204 is formed on a fourth inclined surface 206. Therefore, the fourth inclined surface 206 is an inclined surface inclined downward from the circumferential-direction guiding ledge 202, and is formed on an inclined surface continuing to the second inclined surface 196 of the tip part 162.

A coin C falling from the circumferential-direction guiding ledge 202 slides over the fourth inclined surface 206 to fall into the storing chamber 134.

Next, the shape of a rear surface 208 of the circumferential-direction guiding part 176 of the circumferential-direction guiding body 114 is described. On the rear surface 208, the first passage groove 158 and the second passage groove 160 are each formed in an arc shape. See FIG. 8B.

The first passage groove 158 and the second passage groove 160 each have a depth and a width allowing the corresponding first pusher 152 or second pusher 154 to pass through. The rear surface 208 of the circumferential-direction guiding body 114 is preferably closely arranged so as to be in close contact with the upper surface 136 of the rotary disk 112. This is to make it difficult to have any coin C jammed between the rotary disk 112 and the circumferential-direction guiding body 114 and to make the coin C difficult to fall from the support ledge 174 and the circumferential-direction guiding ledge 202.

Figure 7:
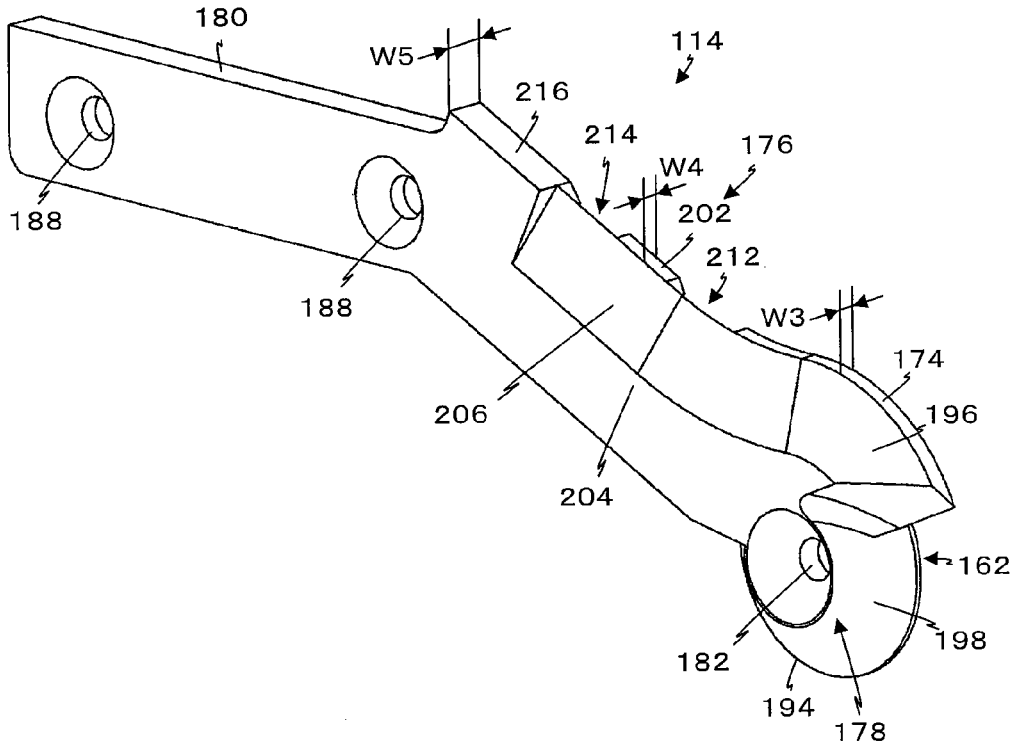
FIG. 7 is a perspective view of a circumferential-direction guiding body in the coin separating and transferring apparatus of the first embodiment of the present invention.
Figure 8:
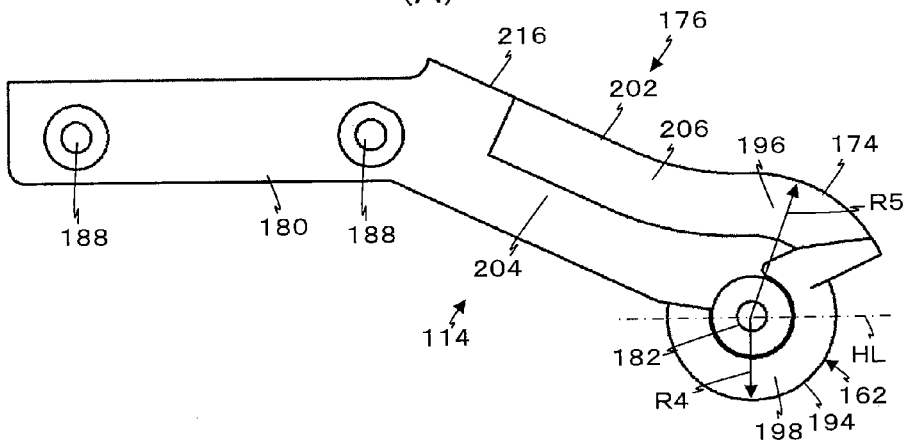
FIG. 8 represents a front view (A) and a back perspective view (B) of the circumferential-direction guiding body in the coin separating and transferring apparatus of the first embodiment of the present invention.
Figure 8:
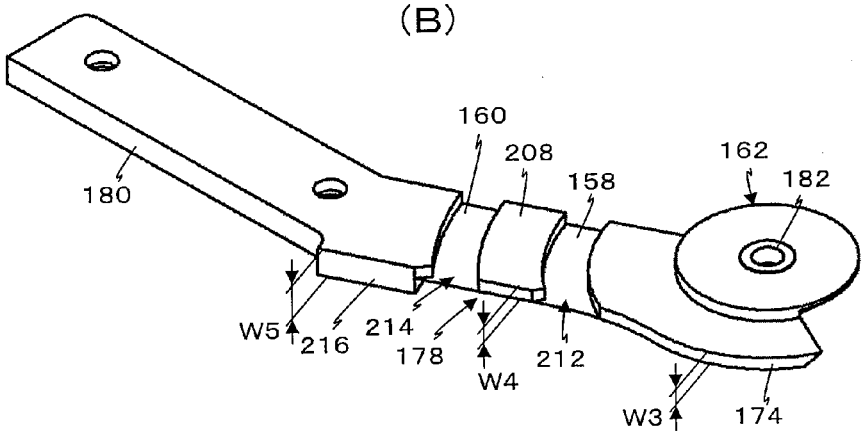

As shown in FIGS. 7 and 8B, portions of the circumferential-direction guiding ledge 202 facing end faces of the first passage groove 158 and the second passage groove 160 are a first opening 212 and a second opening 214, respectively. Therefore, a portion of the circumferential-direction guiding ledge 202 where the first opening 212 and the second opening 214 are positioned is in a line shape and substantially cannot guide the coin C, and thus preferably has a width (a length of the rotary disk 112 in a diameter direction) as small as possible.

In other words, since the coin C is moved with its part of the perimeter surface sinking into the first opening 212 and the second opening 214, the coin C is prevented from falling from the circumferential-direction guiding ledge 202 due to any vibration at the time of sinking movement.

Figure 13:
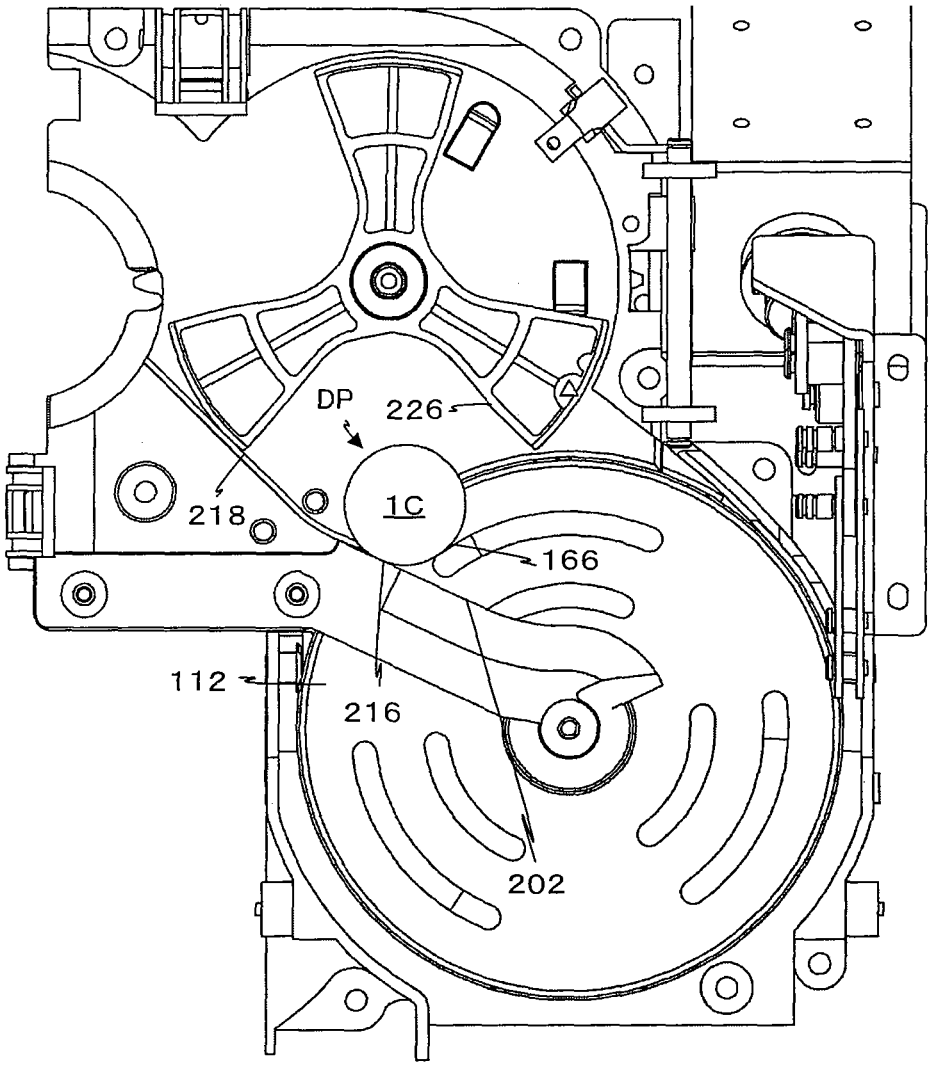
FIG. 13 is a view describing the operation of the coin separating and transferring apparatus of the first embodiment of the present invention (a 1-yen coin supported on the support ledge)

The delivery support ledge 216 has a function of holding the coin C supported by the holding ledges 166 connecting to the pushers 146 of the rotary disk 112 and guided to the circumferential-direction guiding ledge 202 in a stationary state at the delivery position DP. The delivery support ledge 216 is formed on an upper end edge surface of the circumferential-direction guiding body 114 and on a straight line extending from the circumferential-direction guiding ledge 202 at a position facing the upper surface 136 of the rotary disk 112 (see FIG. 13).

Note, the upper or second pusher 154 has its holding ledge releasing the coin 1C at the delivery support ledge 216 in an interim stationary state at the delivery position DP. The outer perimeter edge 168 of the second pusher 154 can still support the coin 1C as the rotary disk 112 continues its rotation and the arc of the second pusher 154 is of sufficient length to enable a synchronized sweeping of the push lever 226 to remove the coin 1C from the delivery position DP.

The delivery support ledge 216 has a fifth width W5 formed so as to have a width (thickness) equal to the width of the straight-shaped center part 188. With the delivery support ledge 216 configured to have a width wider than the fourth width W4 as in the first embodiment, even when a rotary transferring body 224, which will be described further below, collides with the coin C with a shock, the coin C can be advantageously transferred by the rotary transferring body 224 to the next process without falling from the delivery support ledge 216. In the first embodiment, the next process means the coin transferring device 104.

Next, a sensor-part guide 218 is described with referent to FIG. 3. The sensor-part guide 218 has a function of guiding the coin C transferred by the coin transferring device 104 to a sensor part 222.

In the first embodiment, the sensor-part guide 218 is a guide rail with a narrow width linearly extending to form an obtuse angle of approximately 160 degrees with respect to the delivery support ledge 216 (the circumferential-direction guide ledge 202). In the first embodiment, the sensor-part guide 218 is formed approximately within an area having the shape of a right triangle, and is an inclined surface of a guide body 219 fixed to the base 116 with a screw 220 as being put by the mounting part 180. The sensor-part guide 218 has a width equal to the fifth width W5 of the delivery support ledge 216.

Therefore, in the course of being pushed by the coin transferring device 104, the coin C passes through the sensor part 222 as being linearly guided from the delivery support ledge 216 along the sensor-part guide 218, and is then sent to the next process. The next process is, for example, an aligning part that aligns the coins C by denomination.

Next, the coin transferring device 104 is described with reference to FIG. 3. The coin transferring device 104 has a function of receiving the coin C held by the holding ledge 166 and the delivery support ledge 216 in a stationary state at the delivery position DP and then moving the coin at a predetermined speed along the sensor-part guide 218.

In the first embodiment, the coin transferring device 104 is the rotary transferring body 224. The rotary transferring body 224 has push levers 226 as many as the number of holding parts 148 formed on the rotary disk 112. The push levers 226 of the first embodiment include three push levers 226A, 226B, and 226C formed approximately in a fan shape in an equiangular manner. Between these push levers 226A, 226B, and 226C, fan-shaped holding recesses 228 are formed. In the first embodiment, three holding recesses 228A, 228B, and 228C are formed.

The rotary transferring body 224 has its center fixed to a rotary shaft 232, and rotates in conjunction with the rotary disk 112 in a circular closed-end transfer hole 234. In other words, the rotary shaft 232 is rotated in conjunction or synchronization with the rotary disk 112 via a gear (not shown) ganged with the driven gear 142 with a relation of a rotation ratio of one to one. Further, in other words, any one of the push levers 226A, 226B, and 226C is rotated to come to the coin C held by the holding ledge 166 of the pusher 146 and the delivery support ledge 216 in a stationary state at the delivery position DP, and pushes the coin to the clockwise direction in FIG. 3.

A bottom part 236 of the transfer hole 234 is formed in the same plane as the plane where the upper surface 136 of the rotary disk 112 is positioned. Therefore, the rotary transferring body 224 has a function of receiving the coin C that stays still at the delivery position DP and then conveying it to the sensor part 222.

The sensor part 222 has a function of detecting physical properties of the coin C, such as the diameter, thickness, material, and design. In the first embodiment, the sensor part 222 is in a configuration of a coil 238 and arranged on the rear surface of the bottom part 236 of the transfer hole 234 and a coil (not shown) is arranged so as to face a cover 242 (refer to FIG. 1) arranged to cover the transfer hole 234. The sensor part 222 can discriminates between a genuine coin and a counterfeit coin based on information regarding the diameter, thickness, and material of the obtained coin C, and further discriminates the denomination when the coin is a genuine coin.

However, the sensor part 222 is not restricted to a coil as long as it can detect the physical properties of the coin C. For example, the coins can be distinguished between a genuine coin and a counterfeit coin also by detecting the design on the obverse head by using an image sensor.

The operation of the first embodiment is described with reference to FIG. 10 to FIG. 16. First, with reference to FIG. 10 to FIG. 13, a case is described in which a 1-yen coin 1C is held by the holding part 148.

When the coins C are thrown into the storing chamber 134 in a bulk state, they are guided by the inclination of the wall surface of the storing container 108 to a rotary disk 112 side, and are in contact with the rotary disk 112. The rotary disk 112 is automatically rotated upon detection of throwing of the coins or is always rotated.

With the rotation of the rotary disk 112, the coins C are mixed by the first pusher 152 and the second pusher 154 to enter the holding part 148. When the coins C are surface contact with the upper surface 136 (the holding surface 138) of the holding part 148, only one coin C can be in surface contact with the holding surface 138 even in the case of the coin having the smallest diameter C. In this state, when the rotary disk 112 is further rotated in the counterclockwise direction, below the horizontal line HL, the coins C each have its lower-end perimeter surface supported by the inner surface of the storing container 108 and are pushed by the second pusher 154 to move to the same direction (indicated by a chain line in FIG. 3) in most cases.

Figure 10:
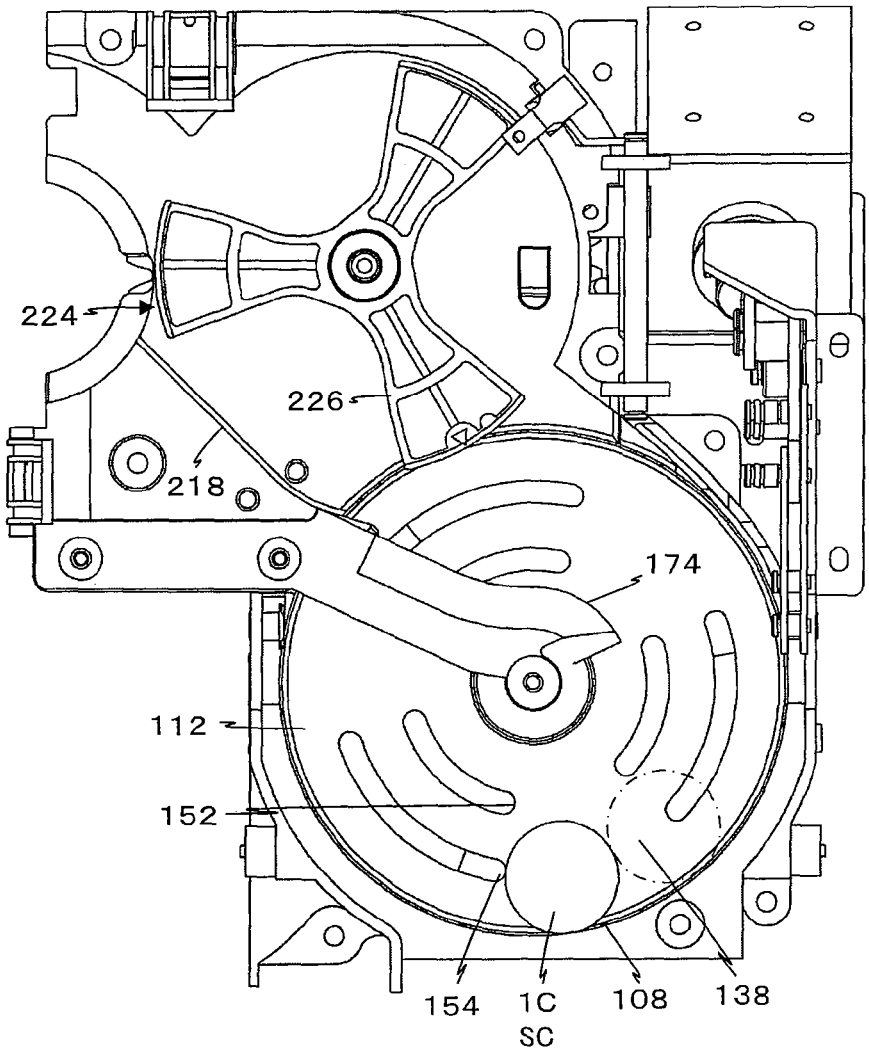
FIG. 10 is a view describing an operation of the coin separating and transferring apparatus of the first embodiment of the present invention (a separated 1-yen coin)

In such cases, since the second height H2 of the second pusher 154 is smaller than the thickness of the thinnest coin C, even if two coins C are stacked, only the coin C in surface contact with the holding surface 138 (the upper surface 136) is pushed (in the state shown in FIG. 10).

Then, when rotation is made upward from the horizontal line HL, only the coin C in surface contact with the holding surface 138 (the upper surface 136) of the holding part 148 is moved together with the rotation of the rotary disk 112.

Furthermore, when the rotary disk 112 moves in a counterclockwise direction to reach a position at an approximately 2 o'clock on a clock, since the coin C has its lower-end perimeter surface unsupported, the moving force by gravitation is increased more than the friction force with the holding surface 138 (the upper surface 136) and, as a result, the coin C slides to fall to a rotation axis line 144 side of the rotary disk 112.

The sliding and falling coin C has its lower-end perimeter surface supported by the support ledge 174 (in a state shown in FIG. 11). If two coins C are stacked, since the support ledge 174 is formed to have the third width W3 smaller than the thickness of the thinnest coin C, the coin C mounted on top of the other coin is not supported by the support ledge 174 and falls to the second inclined surface 196, and thus, only one coin C is positioned in the holding part 148.

Furthermore, when the rotary disk 112 rotates, the coin C is pushed and moved by the first pusher 152 or the second pusher 154 while its lower perimeter surface is guided by the arc-shaped support ledge 174 (refer to FIG. 11). Here, the coin C has its lower-side perimeter surface pushed by the first pusher 152.

The lower-side perimeter surface refers to an arc perimeter surface on a lower side of the coin center of the coin C facing the support ledge 174. With this, when the 1-yen coin 1C is pushed by the first pusher 152, the force in a direction away from the coin support ledge 174 acts on the 1-yen coin 1C (refer to FIG. 11). In other words, since the coin C receives a force from the first pusher 152 so as to decrease a contact pressure between the 1-yen coin 1C and the support ledge 174, a problem of jamming of the coin C in a space with the support ledge 174 does not occur.

Figure 12:
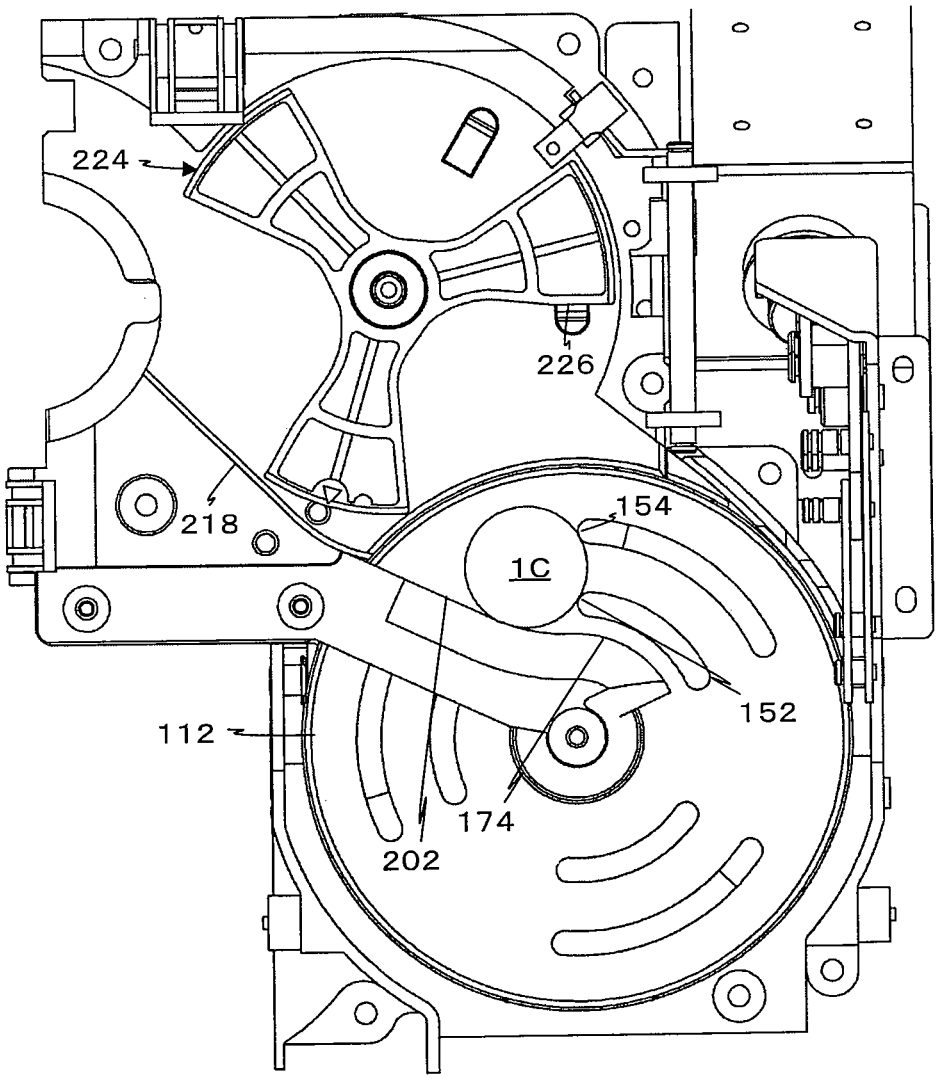
FIG. 12 is a view describing the operation of the coin separating and transferring apparatus of the first embodiment of the present invention (a 1-yen coin while being pushed)

Furthermore, when the rotary disk 112 rotates, the lower perimeter surface of the coin C is guided by the circumferential-direction guiding ledge 202, and is moved to a circumferential direction of the rotary disk 112 (refer to FIG. 12). With this, in the course of moving from the center part to the circumferential direction of the rotary disk 112, the 1-yen coin 1C initially pushed by the first pusher 152 is pushed by the second pusher 154 (refer to FIG. 12).

When the 1-yen coin 1C is pushed by the second pusher 154, the second pusher 154 pushes the perimeter surface shifted far away from the rotation axis line 144 rather than the center of the 1-yen coin 1C, but its shift amount is small, and therefore the force pressing onto the circumferential-direction guiding ledge 202 is hardly increased. Thus, the 1-yen coin 1C is not jammed between the circumferential-direction guiding body 114 and the upper surface 136.

Furthermore, when the rotary disk 112 rotates, the coin C is moved further to a circumferential direction of the rotary disk 112 to be guided to the delivery support ledge 216. Then, from the contact with the second pusher 154, the coin C is moved to the holding ledge 166 to be supported by the holding ledge 166, is inhibited by the delivery support ledge 216 from moving, and becomes in a relatively stationary state at the delivery position DP (refer to FIG. 13).

In other words, even if the rotary disk 112 rotates, the coin C continues to be in a stationary state at the delivery position DP. Immediately after the coin C is positioned at the delivery position DP, the push lever 226 pushes the 1-yen coin 1C.

The 1-yen coin 1C is linearly guided along the sensor guide 218 with the rotation of the push lever 226. In the course of this movement, the 1-yen coin 1C passes through the sensor part 222 and its physical characteristics are detected. Then, based on the information about the physical characteristics detected by the sensor part 222, discrimination is made as to whether the coin C is genuine or counterfeit and its denomination.

Figure 14:
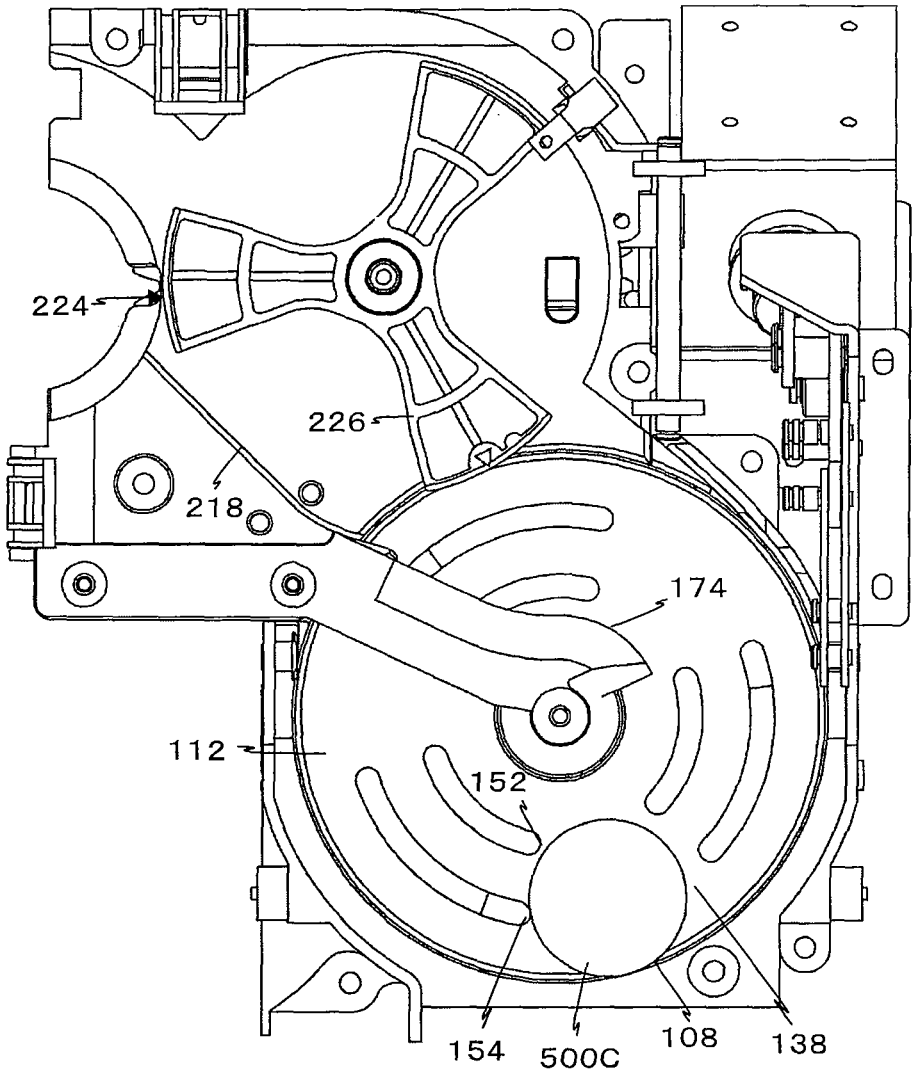
FIG. 14 is a view describing the operation of the coin separating and transferring apparatus of the first embodiment of the present invention (a separated 500-yen coin)
Figure 15:
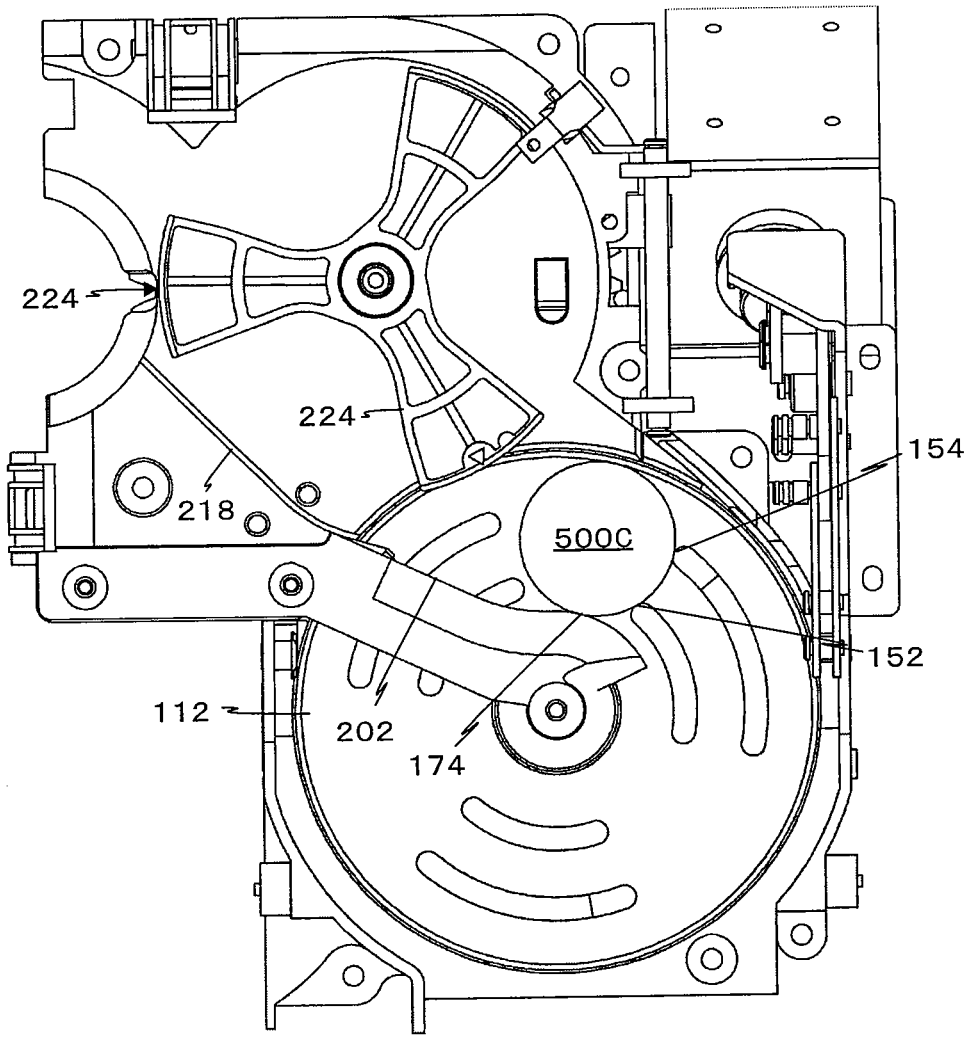
FIG. 15 is a view describing the operation of the coin separating and transferring apparatus of the first embodiment of the present invention (a 500-yen coin supported on the support ledge)
Figure 16:
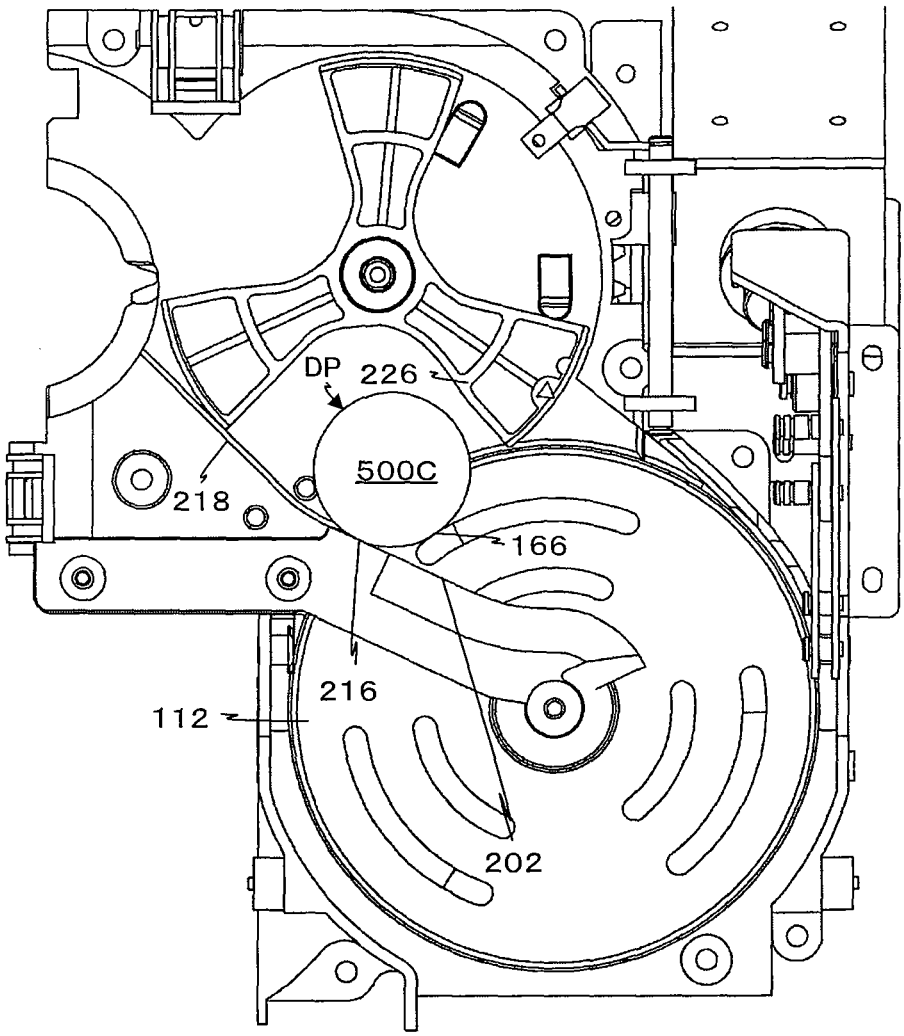
FIG. 16 is a view describing the operation of the coin separating and transferring apparatus of the first embodiment of the present invention (a 500-yen coin supported on the support ledge)

Next, an example of 500-yen coins 500C is described with reference to FIG. 14 to FIG. 16. The 500-yen coins 500C are also mixed with the movement of the first pusher 152 and the second pusher 154, and one 500-yen coin 500C has an in surface contact with any of the holding surfaces 138A, 138B, and 138C of the holding parts 148A, 148B, and 148C (refer to FIG. 14).

From this state, when the rotary disk 112 rotates to a counterclockwise direction, the 500-yen coin 500C is pushed by the second pusher 154 to be moved in a counterclockwise direction. Then, the 500-yen coin 500C slides at an approximately 2 o'clock position on a clock to a support ledge 174 side by its self weight and is supported by the support ledge 174 (refer to FIG. 15). At this time, the 500-yen coin 500C has a positional relation of being pushed also by the second pusher 154.

Next, with further rotation of the rotary disk 112, the 500-yen coin 500C is guided by the support ledge 174, and is guided by the circumferential-direction guiding ledge 202 and then subsequently by the delivery support ledge 216. Then, the 500-yen coin 500C is supported by the holding ledge 166, and is set in a stationary state at the delivery position DP. (Refer to FIG. 16.) Then, the coin is pushed by the push lever 226, and is received in a manner similar to that of the 1-yen coin 1C.

Figure 17:
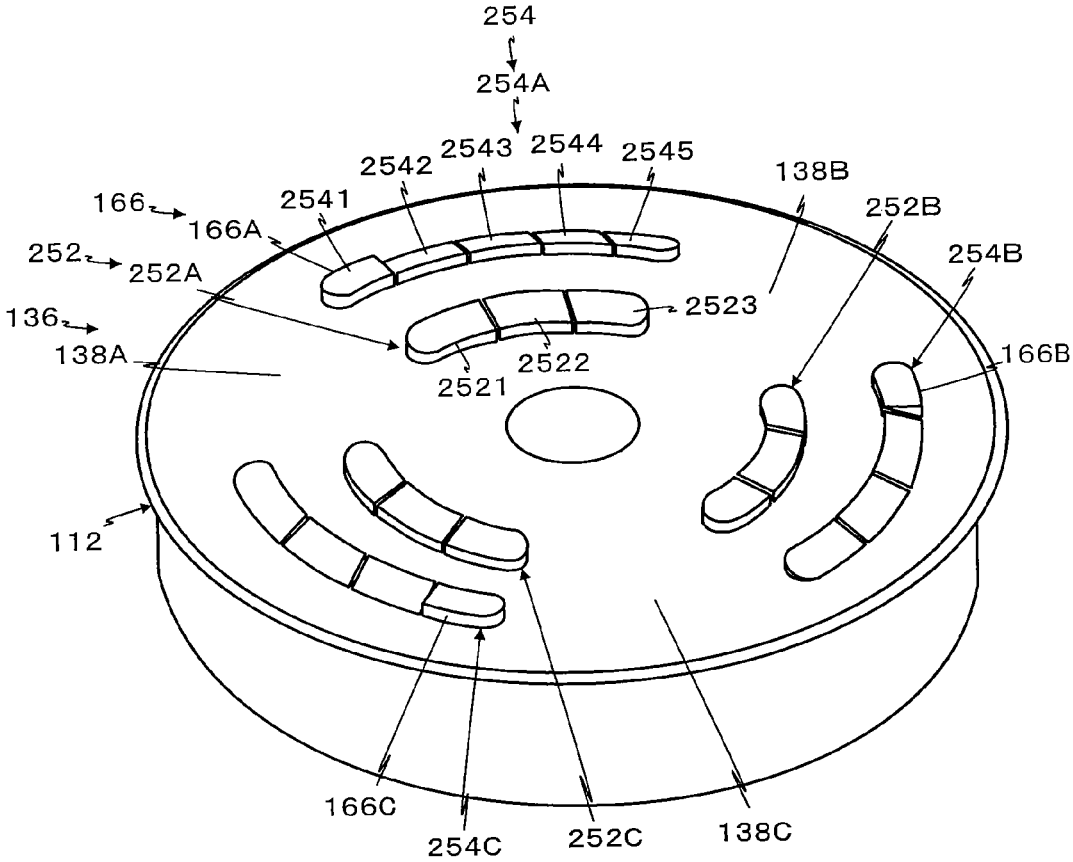
FIG. 17 is a perspective view of rotary disk for use in a coin separating and transferring apparatus of a second embodiment of the present invention.
Figure 18:
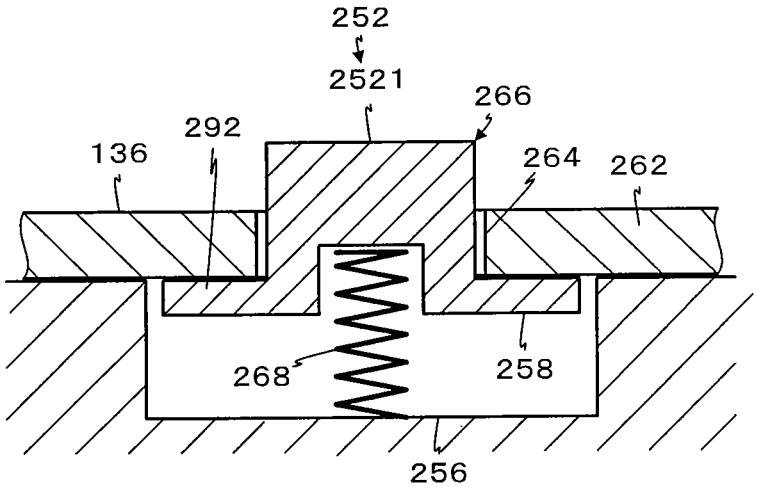
FIG. 18 is a sectional view of a first structure of the coin separating and transferring apparatus of the second embodiment of the present invention.

Next, a second embodiment is described with reference to FIG. 17 and FIG. 18. The second embodiment is an example in which the pusher unit 146 in the first embodiment is divided into plural segments in a longitudinal direction and can elastically go both upward from and backward into the rotary disk 112.

In other words, the pusher 146 can be withdrawn so as to be substantially flush with the upper surface 136 of the rotary disk 112. With this, the first passage groove 158 and the second passage groove 160 for letting the pusher 146 pass through do not have to be formed on the rear surface 208 of the circumferential-direction guiding body 114. Therefore, the shape of the circumferential-direction guiding body 114 can further be simplified and, as a result, it is advantageously possible to manufacture at a low cost.

Also in the second embodiment, the first pusher 252 and the second pusher 254 are provided, and the shape as a whole is identical to that of the first embodiment. That is, also in the second embodiment, the first pusher 252 includes three first pushers 252A, 252B, and 252C equidistantly formed and the second pusher 254 includes three second pushers 254A, 254B, and 254C equidistantly formed.

In the second embodiment, however, each first pusher 252 is configured of a first structure 2521, a second structure 2522, and a third structure 2523, in each longitudinal direction. Also, each second pusher 254 is configured of a first structure 2541, a second structure 2542, a third structure 2543, a fourth structure 2544, and a fifth structure 2545.

Since these structures 2521 to 2523 and 2541 to 2545 elastically project from the upper surface 136 in the same manner, the first structure 2521 is representatively described with reference to FIG. 18.

A lower-end stopper part 258 is inserted in a recessed part 256 formed in the rotary disk 112 to cause a head 266 of the first structure 2521 to project from the upper surface 136 via a passage hole 264 of a lid body 262. An upper surface of the lid body 262 corresponds to the upper surface 136 of the rotary disk 112.

A spring 268 is arranged between a bottom of the recessed part 256 and a lower end face of the first structure 2521 to force the first structure 2521 to project upward from the recessed part 256, thereby causing a stopper 272 at a lower end to engage with the rear surface of the lid body 262 to be in a stationary state at a projection position PP. When the first structure 2521 is pushed down, it can be caused to sink so that the head 266 is flush with the upper surface 136 of the lid body 262.

Therefore, by forming portions facing the first opening 212 and the second opening 214 in the circumferential-direction guiding body 114 on an inclined surface near the upper surface 136 of the rotary disk 112, the first structure 2521 is caused by the inclined surface to sink in the upper surface 136 of the rotary disk 112, and can pass through a lower portion of the circumferential-direction guiding body 114.

Also, when the first structure 2521 passes through the lower portion of the circumferential-direction guiding body 114, it does not receive a pushing force. Therefore, with a resilient force of the spring 268, a stopper 292 projects to be engaged with the lower surface of the lid body 262, thereby returning to an original position.

The second structure 2522 and the third structure 2523 are also caused by the circumferential-direction guiding body 114 to sink in a similar manner and, when passing therethrough, are caused by the spring 268 to project to their original positions.

The same goes for the first structure 2541 to the fifth structure 2545 configuring the second pusher 254.

The present invention is not meant to be restricted to Japanese yen, but can be used with United States coins, Euro coins, British coins, Chinese coins, and those of other countries. Additionally, other tokens can be sorted and dispensed.

When a difference in diameter between the coin having the smallest diameter and the coin having the largest diameter is not large, the pusher 146 can be configured of any one of the first pusher 152 and the second pusher 154.

The rotary disk 112 can have at least one holding part 148. For example, in the first embodiment, the first pushers 152A, 152B, and 152C can be continuously formed in a C shape, and only the holding part 148A can be formed. However, only one coin C can be sorted and sent in one rotation of the rotary disk 112, and therefore the processing capability per unit time is low. Thus, as in the first and second embodiments, a plurality of holding parts 148 are preferably provided to one rotary disk 112 so that a plurality of coins can be released in one rotation of the rotary disk 112.

While the support ledge 174 is formed in an arc shape in the first embodiment, it is not necessarily shaped only in an arc shape. Therefore, the support ledge 174 may be made in a linear shape. However, the shape is preferably an arc, with a radius based on the rotational axis, in order to prevent jamming of the coin C due to pushing of the coin C onto the support ledge 174 at a large angle when the coin C is pushed by the pusher 146.

In the present invention, one or more pushers 146 can be provided. In addition to two in the embodiments, three or more can be provided. With two or more pushers being provided, a pushing direction of each pusher with respect to the circumferential-direction guiding ledge 202 can be set at a shallow angle, in other words, can be set in a direction as parallel as possible to the circumferential-direction guiding ledge 202. Thus, coins from the coins C having small diameters to the coins having large diameters can be advantageously further separated and sent one by one.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A coin separating and transferring apparatus comprising:

a storing container for storing bulk coins;

a rotary disk mounted for rotation about a slanted rotational axis to enable gravitational forces to provide a sliding movement of coins on the rotary disk;

a pusher unit is connected to a surface on the rotary disk for contacting and moving coins on the rotary disk, the pusher unit is positioned on the rotary disk and has an arc shape, with a length in a circumferential direction longer than the largest diameter coin to be stored and a holding edge at a predetermined radius from the rotational axis; and a guiding member is positioned to extend across a portion of the rotary disk and to guide coins for release from the rotary disk and the guiding member includes a coin support ledge and a delivery support ledge, the coin support ledge is arc shape around and above the slanted rotary disk rotational axis, the thickness of the coin support ledge is configured to be equal or thinner than a thickness of the thinnest coin, and extends to the delivery support ledge to provide a stationary coin position prior to the coin release from the rotary disk, and a thickness of the delivery support ledge is wider than thickness of the coin support ledge, wherein the pusher unit will separate a coin from the stored bulk coins and position the separated coin on the coin support ledge, for movement along the guiding member to the stationary coin position, the pusher unit supporting the separated coin at the stationary coin position until removed from the rotary disk.

2. The coin separating and transferring apparatus of claim 1 further including a rotary transferring unit aligned with the stationary coin position to contact and transfer the stationary coin from the rotary disk.

3. The coin separating and transferring apparatus of claim 2 further including a sensor for measuring a property of the coin operatively positioned in the rotary transferring unit.

4. The coin separating and transferring apparatus of claim 1 wherein the pusher unit is positioned on the rotary disk and has an arc shape, with a length in a circumferential direction longer than the largest diameter coin to be stored and a holding edge at a predetermined radius from the rotational axis.

5. The coin separating and transferring apparatus of claim 4 wherein the coin is supported at the stationary coin position by the delivery support ledge and the holding edge while the rotary disk rotates.

6. The coin separating and transferring apparatus of claim 4 wherein the pusher unit has an inclined surface, from a rear side of the pusher unit relative to the holding edge, that extends downward towards an upper surface of the rotary disk adjacent the holding edge.

7. The coin separating and transferring apparatus of claim 1 wherein the pusher unit includes a first pusher positioned a first distance away from the rotational axis and a second pusher positioned a second distance away from the rotational axis, which is larger than the first distance, wherein when a coin having the smallest diameter of the bulk coins is supported on the coin support ledge, the first pusher is configured to push a perimeter surface of the coin closer to the rotational axis than a center of the coin.

8. The coin separating and transferring apparatus of claim 7 wherein the second pusher is configured to also push the smallest diameter coin along the guiding member in a circumferential direction of rotation of the rotary disk.

9. The coin separating and transferring apparatus of claim 8 wherein the second pusher has an inclined surface, from a rear side of the second pusher relative to a second holding edge, that extends downward towards an upper surface of the rotary disk adjacent the second holding edge.

10. The coin separating and transferring apparatus of claim 1 wherein the pusher unit in contact with the bulk coins is formed of metal.

11. The coin separating and transferring apparatus of claim 1 wherein the pusher unit is configured of a plurality of pushers that are mounted on the rotary disk to be movably biased to a position above the surface of the rotary disk and configured to be forced downward into the rotary disk when contacting and passing under the guiding member.

12. The coin separating and transfer apparatus of claim 1 wherein the storing container is mounted for pivoting upward from the rotary disk by an actuator.

13. A coin separating and transferring apparatus comprising:

a storing container for storing bulk coins;

a rotary disk mounted for rotation about a slanted rotational axis to enable gravitational forces to provide sliding movement of coins on the rotary disk;

a pusher unit is connected to a surface on the rotary disk for contacting and moving coins on the rotary disk, the pusher unit is positioned on the rotary disk and has an arc shape, with a length in a circumferential direction longer than the largest diameter coin to be stored and a holding edge at a predetermined radius from the rotational axis;

a guiding member is positioned to extend across a portion of the rotary disk and to guide coins for release from the rotary disk and the guiding member includes a coin support ledge and a delivery support ledge, the coin support ledge is arc shape around and above the slanted rotary disk rotational axis, the thickness of the coin support ledge is configured to be equal or thinner than a thickness of the thinnest coin, and extends to the coin support ledge, the delivery support ledge to provide a stationary coin position prior to the coin release from the rotary disk, and a thickness of the delivery support ledge is wider than the thickness of the coin support ledge; and a rotary transferring unit having a plurality of push levers, is aligned with the stationary coin position to contact and transfer the stationary coin from the rotary disk by contact with one of the push levers, wherein the pusher unit will separate a coin from the stored bulk coins and position the separated coin on the coin support ledge, for movement along the guiding member to the stationary coin position, the pusher unit supporting the separated coin at the stationary coin position until removed from the rotary disk.

14. The coin separating and transferring apparatus of claim 13 further including a sensor for measuring a property of the coin operatively positioned in the rotary transferring unit.

15. The coin separating and transferring apparatus of claim 14 wherein the pusher unit is positioned on the rotary disk and has an arc shape, with a length in a circumferential direction longer than the largest diameter coin to be stored and a holding edge at a predetermined radius from the rotational axis.

16. The coin separating and transferring apparatus of claim 15 wherein the coin is supported at the stationary coin position by the delivery support ledge and the holding edge while the rotary disk rotates a pusher unit relative to the coin until contact with one of the push levers of the rotary transferring unit.

17. The coin separating and transferring apparatus of claim 13 wherein the pusher unit includes a first pusher positioned a first distance away from the rotational axis and a second pusher positioned a second distance away from the rotational axis, which is larger than the first distance, wherein when a coin having the smallest diameter of the bulk coins is supported on the coin support ledge, the first pusher is configured to push a perimeter surface of the coin closer to the rotational axis than a center of the coin.

18. The coin separating and transferring apparatus of claim 17 wherein the second pusher is configured to also push the smallest diameter coin along the guiding member in a circumferential direction of rotation of the rotary disk.

19. The coin separating and transferring apparatus of claim 13 wherein the pusher unit is configured of a plurality of pushers that are mounted on the rotary disk to be biased above the surface of the rotary disk and configured to be forced downward when contacting the guiding member.

20. A coin separating and transferring apparatus comprising:

a storing container for storing bulk coins;

a rotary disk mounted for rotation about a rotational axis to contact any bulk coins in the storage container, the rotary disk is mounted at an angle to gravitational forces to enable a sliding movement of coins on the rotary disk;

a guiding member is positioned to extend across a portion of the rotary disk and to direct coins for release from the rotary disk and includes a coin support ledge positioned above the slanted rotary disk rotational axis and extending to a delivery support ledge which provides a stationary coin position prior to the coin release from the rotary disk;

a pusher unit is connected to a surface on the rotary disk for contacting and moving coins on the rotary disk and includes a first pusher positioned a first distance away from the rotational axis and a second pusher positioned a second distance away from the rotational axis, which is larger than the first distance, wherein when a coin having the smallest diameter of the bulk coins is supported on the coin support ledge, the first pusher is configured to push a perimeter surface of the coin closer to the rotational axis than a center of the coin, wherein the second pusher has an inclined surface, from a rear side of the second pusher relative to a second holding edge, that extends downward towards an upper surface of the rotary disk adjacent the second holding edge and is configured to also push the smallest diameter coin along the guiding member in a circumferential direction of rotation of the rotary disk; and a rotary transferring unit having a plurality of push levers, is aligned with the stationary coin position to contact and transfer the stationary coin from the rotary disk by contact with one of the push levers, wherein the pusher unit will separate a coin from the stored bulk coins and position the separated coin on the coin support ledge, for movement along the guiding member to the stationary coin position, the pusher unit supporting the separated coin at the stationary coin position until removed from the rotary disk by the rotary transferring unit.

* * * * *